US012760527B2

(12) United States Patent
Kwon

(10) Patent No.: US 12,760,527 B2
(45) Date of Patent: Oct. 13, 2026

(54) COMPOSITE PANEL FOR PREVENTING SPREAD OF FIRE

(71) Applicant: MINYE CO., LTD., Seoul (KR)

(72) Inventor: Hyuk Jun Kwon, Seoul (KR)

(73) Assignee: MINYE CO., LTD., Seoul (KR)

( * ) Notice: Subject to any disclaimer, the term of this patent is extended or adjusted under 35 U.S.C. 154(b) by 193 days.

(21) Appl. No.: 18/760,065

(22) Filed: Jul. 1, 2024

(65) Prior Publication Data

US 2025/0012084 A1 Jan. 9, 2025

(30) Foreign Application Priority Data

Jul. 7, 2023 (KR) ..... 10-2023-0088662

(51) Int. Cl.
*E04F 13/08* (2006.01)
*E04F 13/14* (2006.01)

(52) U.S. Cl.
CPC ..... *E04F 13/0846* (2013.01); *E04F 13/0875* (2013.01); *E04F 13/144* (2013.01)

(58) Field of Classification Search
CPC ..... E04F 13/0846; E04F 13/0875
See application file for complete search history.

(56) References Cited

U.S. PATENT DOCUMENTS 4,307,551 A * 12/1981 Crandell ..... E04F 13/0808 52/235
5,749,282 A * 5/1998 Brow ..... E04H 5/10 52/302.1

(Continued)

FOREIGN PATENT DOCUMENTS

DE 4004103 A1 * 8/1991 ..... E04F 13/081
DE 4337878 C2 * 3/1997 ..... E04B 1/942

(Continued)

OTHER PUBLICATIONS

Extended European Search Report (EESR) issued on Nov. 22, 2024 in the corresponding European Patent Application No. 24176928.0.

*Primary Examiner* — Babajide A Demuren
(74) *Attorney, Agent, or Firm* — AJU IP Global PLLC

(57) ABSTRACT

The present invention relates to a wall coupling structure using an exterior composite panel in which an insulation panel unit is combined with an ultra-slim stone panel for fire safety management, and more specifically, to a wall coupling structure using an exterior composite panel which is designed for construction in the absence of a retaining wall, has excellent aesthetics and strength, can prevent whitening and condensation, can allow mass production, and can reduce manufacturing costs and construction time due to convenience of construction. The vertical-horizontal frame structure (200) includes a vertical bar (210) and a horizontal bar (220) formed as a quadrangular frame for installation of the composite panel outside a retaining wall. The vertical bar (210) includes an upper vertical bar (210a) and a lower vertical bar (210b) and is connected by an expansion joint (230) at a portion at which an access floor (AF) is formed. Therefore, the wall coupling structure using an exterior composite panel can prevent a fire from spreading due to an insulation material during a fire by covering the exterior of the insulation material, which is used for buffering such as supporting, with mortar and bonding a slim stone material to a surface of the insulation material.

5 Claims, 23 Drawing Sheets

(56) References Cited

U.S. PATENT DOCUMENTS

| | | | | |
|---|---|---|---|---|
| 6,226,947 | B1 * | 5/2001 | Bado | E04F 13/0816 52/479 |
| 8,468,765 | B1 * | 6/2013 | Kim | E04F 13/14 52/510 |
| 9,469,999 | B1 * | 10/2016 | Aboukhalil | E04F 13/0816 |
| 2015/0300008 | A1 * | 10/2015 | Gosling | E04C 2/46 52/506.05 |

FOREIGN PATENT DOCUMENTS

| | | | | | |
|---|---|---|---|---|---|
| EP | 0183620 | A1 * | 6/1986 | | E04F 13/04 |
| KR | 100900062 | B1 * | 6/2009 | | E04F 13/0825 |
| KR | 1662780 | B1 * | 10/2016 | | |
| KR | 101838892 | B1 * | 3/2018 | | E04B 1/76 |
| KR | 10-1995382 | B1 | 10/2019 | | |
| KR | 10-2136753 | B1 | 7/2020 | | |
| KR | 20220165333 | A * | 12/2022 | | E04H 9/021 |
| KR | 20240080562 | A * | 6/2024 | | E04C 2/52 |
| KR | 20260019813 | A * | 2/2026 | | E04F 13/0875 |
| NL | 1006233 | C2 * | 12/1998 | | E04F 13/081 |
| WO | 2002040801 | A1 | 5/2002 | | |
| WO | WO-0240801 | A1 * | 5/2002 | | E04B 2/96 |
| WO | WO-2004015220 | A1 * | 2/2004 | | E04F 13/0808 |
| WO | WO-2009046718 | A2 * | 4/2009 | | E04B 1/942 |

* cited by examiner (a)

(b)

COMPOSITE PANEL FOR PREVENTING SPREAD OF FIRE

CROSS-REFERENCE TO RELATED APPLICATION

This application claims priority to and the benefit of Korean Patent Application No. 10-2023-0088662, filed on Jul. 7, 2023, the disclosure of which is incorporated herein by reference in its entirety.

BACKGROUND

1. Field of the Invention

The present invention relates to a composite panel for preventing the spread of a fire due to an insulation material during a fire by simultaneously covering the exterior of the insulation material with mortar and coupling an ultra-slim stone tile to a surface of the insulation material, and a unit wall coupling structure using the same and, more specifically, to a composite panel for preventing the spread of a fire using an insulation material during a fire by simultaneously covering the exterior of the insulation material and coupling a ultra-slim stone tile to a surface of the insulation material, which is designed for construction in the absence of a retaining wall, provides excellent aesthetics and strength, prevents efflorescence and condensation, enables mass production, reduces manufacturing costs and construction time due to simplified installation, and a unit wall coupling structure using the same, wherein the composite panel and the unit wall coupling structure using the same can improve functionality as a complete non-combustible material and reduce construction time by improving the combination structure of fire-resistant panels and insulation materials, withstand earthquakes, typhoons, and others, and prevent condensation on a window frame.

2. Discussion of Related Art

In the background of the conventional invention, when referring to the accompanying drawings, FIG. 1 shows Korean Patent Registration No. 10-1995382 patented by the present inventor (Title: Wall Coupling Structure Using Exterior Composite Panel Combined with Ultra-Slim Stone Panel in Insulation Panel Unit). An exterior panel 230 includes an insulation material 232 molded in a plate shape with a plurality of hollows as a whole and a mesh WM surrounding the exterior of the insulation material 232. For convenience of construction, the exterior panel 230 is formed in a quadrangular shape with a predetermined thickness, and the hollow also has a quadrangular shape.

The insulation material 232 may be any of commonly used insulation materials such as a polyurethane insulator, an expanded polystyrene (EPS) insulator, a panel foam insulator, a phenolic foam (PF) board insulator, a bulk insulator, a fiberglass mat insulator, a mineral wool mat insulator, a rock wool insulator, a polyurethane foam insulator, a composite insulator, etc.

Further, a steel material, exemplified by a wire mesh, may be used as the mesh WM, but nets made of glass fiber is used when considering the convenience of construction such as cutting and installation.

Further, each edge of the exterior panel 230 is processed to have steps 323 and 325, which correspond to each other, to fit with an adjacent exterior panel 230, allowing the seams to securely interlock and be firmly fixed.

Generally, the size of the exterior panel is standardized, but by dividing the exterior panels as described above, a custom insulation panel unit can be manufactured to fit the size. The exterior panels can be coupled easily and combined more securely by forming the steps on the side of the exterior panel and coupling the steps for connection of the exterior panels.

Furthermore, as coating mortar M contains wood fibers, the strength of the coating mortar M is increased when the coating mortar M absorbs water, and thus the strength is further increased when the coating mortar M is sprayed.

FIGS. 2A and 2B are a top view and a side sectional view of examples of a variable panel fixing angle of the exterior composite panel according to the conventional invention. A panel fixing angle 530 is formed as a composite panel connecting part 531 in a horizontal direction and an angle bolt connector 532 in a perpendicular direction. The composite panel connecting part 531 is divided into a length adjusting piece 151 and an anchor bolt connecting piece 152, each of the length adjusting piece 151 and the anchor bolt connecting piece 152 has a length adjusting long hole 153, and the length adjusting piece 151 and the anchor bolt connecting piece 152 are coupled by bolts B through the length adjusting long hole 153. The bolt B and the nut N allow the length adjusting piece 151 to be coupled to the anchor bolt connecting piece 152 using a washer Wa as a base. An anchor bolt 560 is coupled to a height adjustment long hole 154 of the angle bolt connector 532.

Therefore, the length of the panel fixing angle 530 can be adjusted by loosening the nut N of the tightened bolt B.

The following describes a state of the exterior composite panel installed on a wall according to the conventional invention.

FIG. 3 is a side cross-sectional view illustrating a state in which the exterior composite panels according to the conventional invention are vertically coupled, and FIG. 4 is a top view illustrating a state in which the exterior composite panels according to the conventional invention are vertically coupled.

FIG. 3 is a side sectional view showing a state in which the panel fixing angle 530 couples the vertically coupled exterior composite panels to a wall W using the anchor bolt 560 to vertically couple an insulation panel unit 310 combined with an ultra-slim stone panel 320 and an insulation panel unit 510 coupled with an ultra-slim stone panel 520.

The insulation panel unit 310 and the insulation panel unit 510 are covered with polymer mortar 3151 and polymer mortar 5151. An upper panel catching groove 3152 and a lower panel catching groove 5152 are formed in a junction edge of the insulation panel unit 310 and the insulation panel unit 510 so that a downward catching part fastener 540 is inserted into the upper and lower panel catching grooves 3152 and 5152 to enhance the rigidity of the edge. An upward catching part 534 and a downward catching part 535 of the panel fixing angle 530 is fitted into the polymer mortar 3151 and the polymer mortar 5151.

Therefore, a fire-retardant polyurethane foam filling section 5155 is formed to withstand vibrations such as earthquakes by evenly filling the gap between the insulation panel unit 310 and the insulation panel unit 510, which are coupled, with fire-retardant polyurethane foam.

In addition, a gap is formed when the ultra-slim stone panel 320 is combined with the ultra-slim stone panel 520, and a sealing caulking part 3355 is formed in the gap. The gap is filled with an epoxy and sealed to withstand vibrations such as earthquakes.

FIG. 4 is a top view showing a state in which the conventional exterior composite panels are vertically coupled. FIG. 4 shows that the panel fixing angle 530 couples the exterior composite panel to the wall W using an anchor bolt 560 to vertically couple the insulation panel unit 310 combined with the ultra-slim stone panel 320 to the insulation panel unit 510 (not shown) combined with the ultra-slim stone panel 520.

The insulation panel unit 310 is covered with the polymer mortar 3151, and the upper panel catching groove 3152 is formed in the junction edge of the insulation panel unit 310.

A state in which the exterior composite panel in the conventional invention is constructed on a window frame will be described below.

FIG. 5 is a side sectional view showing a state in which the exterior composite panel in the conventional invention is coupled to an upper part of the window frame, and FIG. 6 is a side sectional view showing a state in which the exterior composite panel in the conventional invention is coupled to a lower part of the window frame.

As shown in FIG. 5, the composite panel is attached to the wall on an upper side, and a window frame 5159 is formed on a lower side, and the composite panel is fixed to the top of the window frame 5159.

The composite panel disposed at the top of the window frame 5159 is coupled to the wall W using a panel fixing angle 630 and an anchor bolt 660. A fastener catching groove 5156 is formed in the insulation panel unit 510 and the ultra-slim stone panel 520 at an end portion of the panel fixing angle 630. T-shaped left and right-side catching parts 664*a* and 665*b* of the panel fixing angle 630 are fixedly inserted into the angle catching groove of an exterior material fastener 640 coupled to the fastener catching groove 5156.

In this case, the left and right-side catching parts 664*a* and 665*b* may be bent and fixed to only one side that is inserted into the angle catching groove of the exterior material fastener 640. The exterior material fastener 640 is fitted between both composite insulation materials, and the left and right-side catching parts 664*a* and 665*b* of the panel fixing angle 630 may be fixedly fitted into the angle catching grooves of the exterior material fastener 640.

A bottom ultra-slim stone panel 720 is attached to the bottom of the insulation panel unit 510 to form a panel catching groove 711, and an "L"-shaped panel fixing angle 730 is inserted into the panel catching groove 711 to fix the insulation panel unit 510.

In this case, a "ㄹ"-shaped lower end fixing fastener, which is inserted into an edge of the insulation panel unit 510 and a stone catching groove 721 of the bottom ultra-slim stone panel 720, is installed.

Further, the bottom ultra-slim stone panel 720 includes drip inducers 725 longitudinally formed in a size of 6 mm at regular intervals near a portion attached to the ultra-slim stone panel 520 to prevent water from seeping around the window frame, thereby preventing condensation and mold generated between an inner side of the window frame (cool) and the interior wall (warm).

As shown in FIG. 6, a window frame 3159 is formed at the top of the insulation panel unit 310, and the composite panel at the bottom of the window frame 3159 is fixedly attached to the wall.

The composite panel disposed at the bottom of the window frame 3159 is coupled to the wall W using the panel fixing angle 630 and an anchor bolt 660. A fastener catching groove 3156 is formed in the insulation panel unit 310 and the ultra-slim stone panel 320 at the end of the panel fixing angle 630, and the "T"-shaped left and right-side catching parts 664*a* and 665*b* of the panel fixing angle 630 are fixedly fitted into the angle catching groove of the exterior material fastener 640 inserted into the fastener catching groove 3156.

In this case, the left and right-side catching parts 664*a* and 665*b* may be bent and fixed to only one side that is fitted into the angle catching groove 642 of the exterior material fastener 640. The exterior material fastener 640 is fitted between both composite insulation materials, and an upward catching part 664*a* or a downward catching part 665*b* of the panel fixing angle 630 may be fixedly fitted into the angle catching groove of the exterior material fastener 640.

As described above, a structure in which the sides of the insulation panel unit 510 and the ultra-slim stone panel 520 shown in FIG. 6 are fixed to the wall W using the panel fixing angles 630 has been developed. The structure prevents water from seeping around the window frame using the insulation material at the portion at which the window frame at the top of the insulation panel unit 310 is coupled, thereby preventing condensation between an inner side of the window frame and the interior wall.

Further, a structure in which the panel fixing angle 530 allows the exterior composite panel to be coupled to the wall W by an anchor bolt 560 from a side of the insulation panel unit 310 to couple the insulation panel units 310 and 510 combined with the ultra-slim stone panels 320 and 520, wherein a gap between the ultra-slim stone panels 320 and 520 is filled with an epoxy so that the ultra-slim stone panels 320 and 520 are fixedly coupled to prevent shaking such as earthquake, has been developed.

However, in the conventional invention, the exterior composite panel is attached to the retaining wall, and the insulation panel units 310 and 510 are attached near the wall or the window frame. Thus, there is a problem of a fire rapidly spreading to the exterior wall in the event of a fire.

SUMMARY OF THE INVENTION

The present invention is directed to providing a structure of a composite panel capable of primarily preventing a fire using an exterior composite panel, blocking the fire through spatial layers while maintaining gaps, and thirdly blocking the fire using asbestos boards (AB) by using a vertical bar or a horizontal bar for fire safety management, thereby addressing the problem of further human casualties due to a fire spreading in the event of a fire. This is because, in the conventional invention, the exterior composite panel can be constructed directly to a retaining wall when the retaining wall is present, whereas when the retaining wall is not present, the exterior composite panel cannot be constructed directly to the retaining wall.

Additionally, additional objectives of the present invention are as follows.

The present invention is directed to providing a structure in which the insulation panel is lightweight when attached to a wall, is resilient to earthquakes or strong winds, and is easily installed as a dry structure during construction to provide convenient attachment to a surface of the wall.

The present invention is directed to providing a structure of which a portion, which is damaged when an external impact is applied to a wall, is repairable, and particularly, which maintains the durability of the building against moisture from heavy rain or snow and condensation due to temperature differences at window frames.

The present invention is directed to providing a soundproofing and heat insulation panel unit, which is economical due to excellent surface strength and surface warping prevention by being manufactured in a factory by integrating an insulation layer and a finishing layer into the most simplified layer, breaking away from conventional methods in the production of insulation panels, and a wall coupling structure using the same.

The present invention is directed to providing a soundproofing and heat insulation panel unit which is firmly attached to a structural body by improving the composition of adhesive mortar, and a wall coupling structure using the same.

The present invention is directed to providing a soundproofing and heat insulation panel unit which provides excellent durability, structural stability, fire resistance, sound insulation performance, insulation performance, and moisture resistance by improving a structure of the insulation panel, and a wall coupling structure using the same.

The present invention is directed to providing a soundproofing and heat insulation panel unit, which allows even inexperienced workers to construct the soundproofing and heat insulation panel unit with a predetermined level of quality using standardized components for dry construction and is economical due to easy maintenance, and a wall coupling structure using the same.

The present invention is directed to providing a soundproofing and heat insulation panel unit, which can be directly applied as an insulation panel and an inter-floor noise reduction material to existing buildings without separate design changes, and a wall coupling structure using the same.

According to an aspect of the present invention, there is provided a unit wall coupling structure of a composite panel, which prevents a fire from spreading due to insulation materials during a fire by simultaneously covering the exterior of an insulation material with mortar and bonding an ultra slim stone tile to a surface of the composite panel, which is a unit wall coupling structure using an exterior composite panel in which an insulation panel unit is combined with an ultra-slim stone panel, wherein the unit wall coupling structure includes a wall structure part (100), a vertical-horizontal frame structure (200), an insulation panel unit member (300), a panel fixing angle member (500), and a wall vertical connection member (800), the vertical-horizontal frame structure (200) includes a vertical bar (210) and a horizontal bar (220) formed as a quadrangular frame for installation of the composite panel outside a retaining wall, and the vertical bar (210) includes an upper vertical bar (210*a*) and a lower vertical bar (210*b*) that are connected by an expansion joint (230) at a portion at which an access floor (AF) is formed.

The expansion joint (230) may be a flat rectangular steel plate, at an upper portion of the expansion joint (230), upper expansion joints (230*a*) of the expansion joints (230) may be fastened to both sides of the upper vertical bar (210*a*) by upper and lower vertical bar connecting bolts (213*a* and 213*b*) at a lower portion of the expansion joint (230), lower expansion joints (230*c*) may be fixed to both sides of the lower vertical bar (210*b*) by welding, the vertical-horizontal frame structure (200) may be connected with the insulation panel unit member (300) at a portion at which the expansion joint (230) of the horizontal bar (220) is connected, an upper horizontal bar (220*a*) and a lower horizontal bar (220*b*) may be fastened by a "⊏"-shaped upper fastener (361) and a "⊏"-shaped lower fastener (362), one end (372*a*) of an "L"-shaped angle member (370*a*), which is bent into an "L"-shape from a fastener middle part (361*a*) of the "⊏"-shaped upper fastener (361), may be welded to a lower end of the upper horizontal bar (220*a*) formed on the upper vertical bar (210*a*), a fastener connecting end portion, which is bent into the "L"-shape from a fastener middle part (362*a*) of the "⊏"-shaped upper fastener (361), may be fastened to the "L"-shaped angle member by a bolt (B) and a nut (N) through a bolt hole of the other end (371*b*) of the "L"-shaped angle member (370*a*), and the "⊏"-shaped upper fastener (362) may be fastened to an "L"-shaped angle member (370*b*) by welding one end (372*b*) of the "L"-shaped angle member (370*b*), which is bent into an "L"-shape, to an upper end of the lower horizontal bar (220*b*) formed on the lower vertical bar (210*b*), and fastening the "⊏"-shaped fastener (362) using a bolt (B) and a nut (N) through a bolt hole of the other end (371*b*).

The panel fixing angle member (500) may include a panel fixing angle (510) and an "L"-shaped connection angle (520) and is coupled to the horizontal bar (220) by a bolt and a nut, the "L"-shaped connection angle (520) may be fastened to an "L"-shaped connecting bracket (221) using a bolt (B) and a nut (N) to correspond to an "L"-shaped connection angle long hole (524) formed in a vertical connecting bracket (522) of the "L"-shaped connection angle (520) and a bolt hole (224) formed in the vertical connecting bracket (223) of the "L"-shaped connecting bracket (221), the bolt holes may be formed in the middle part of the vertical bar (210), and "L"-shaped angle members (540) fixed to the wall (W) and having an "L"-shape" may be fastened to the vertical bar (210) by a bolt (B) and a nut (N) through a gap adjusting groove (543) formed in a vertical bar fastening angle part (541), and the "L"-shaped angle members (540) may be fastened to the wall (W) by a bolt (B) and a nut (N) of an anchor bolt (560) through a gap adjusting groove (545) of the "L"-shaped connection angle long hole (542) formed in the other side of the "L"-shaped angle members (540).

The wall vertical connection member (800) may be coupled to the wall (W) by the anchor bolt (560), and an "L"-shaped wall connecting bracket (820) may be fastened to the vertical bar (210) by a bolt (B) and a nut (N) through a gap adjusting groove (831) of an "L"-shaped vertical bar connecting bracket (810) on one side of the wall vertical connection member (800) and is fastened to the wall (W) on the floor by the bolt (B) and the nut (N) of the anchor bolt (560) through a bolt hole (832) of the "L"-shaped vertical bar connecting bracket (810) on the other side of the wall vertical connection member (800).

The wall vertical connection member (800) may be coupled to the wall (W) by the anchor bolt (560) and may be fastened to a steel plate bracket (840) fixed to the wall (W) on the floor through the bolt hole (832) of the "L"-shaped vertical bar connecting bracket (810), and connection bracket reinforcing plates (830) may be formed on the "L"-shaped vertical bar connecting brackets (810 and 820) on one side and the other side of the wall vertical connection member (800).

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
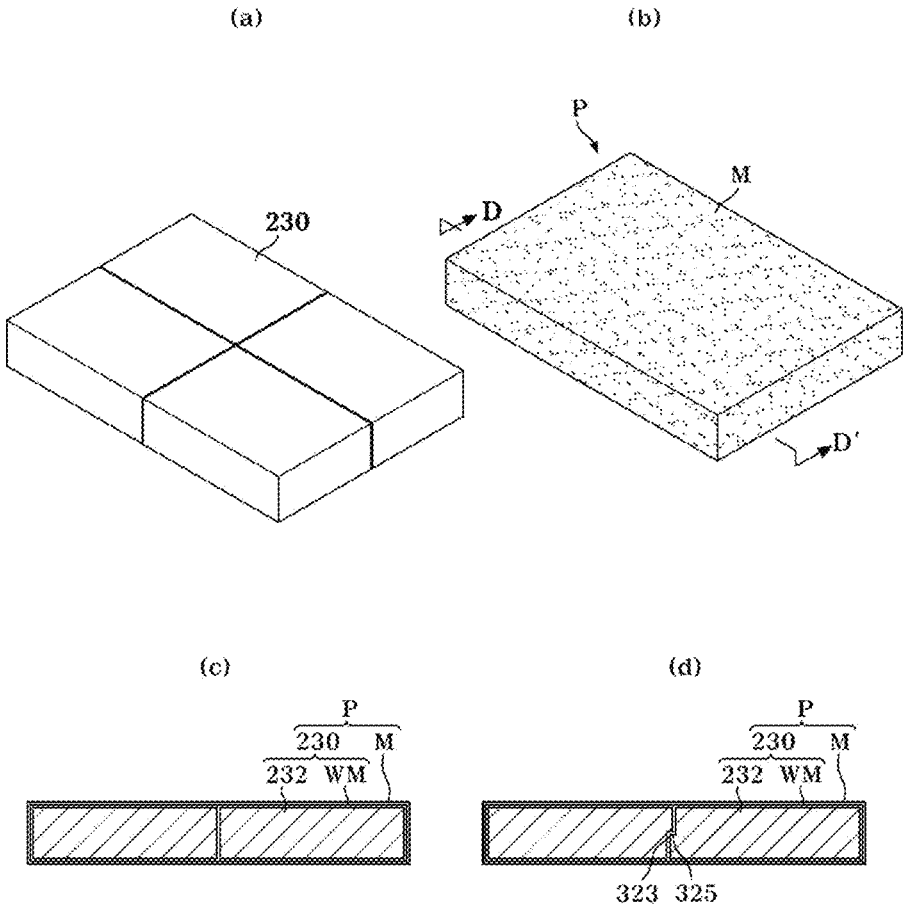
FIG. 1A is a manufacturing process of an insulation panel unit formed by dividing an exterior panel of the conventional invention, developed by the inventor of the present invention, into four equal parts and assembling the four equal parts into a rectangular shape.
FIG. 1B is a perspective view illustrating the appearance of the exterior panel covered with mortar.
FIG. 1C is a cross-sectional view along line D-D' in FIG. 1B.
FIG. 1D is a cross-sectional view of an insulation panel unit combined by an insulation material connecting part with a step.
Figure 2:
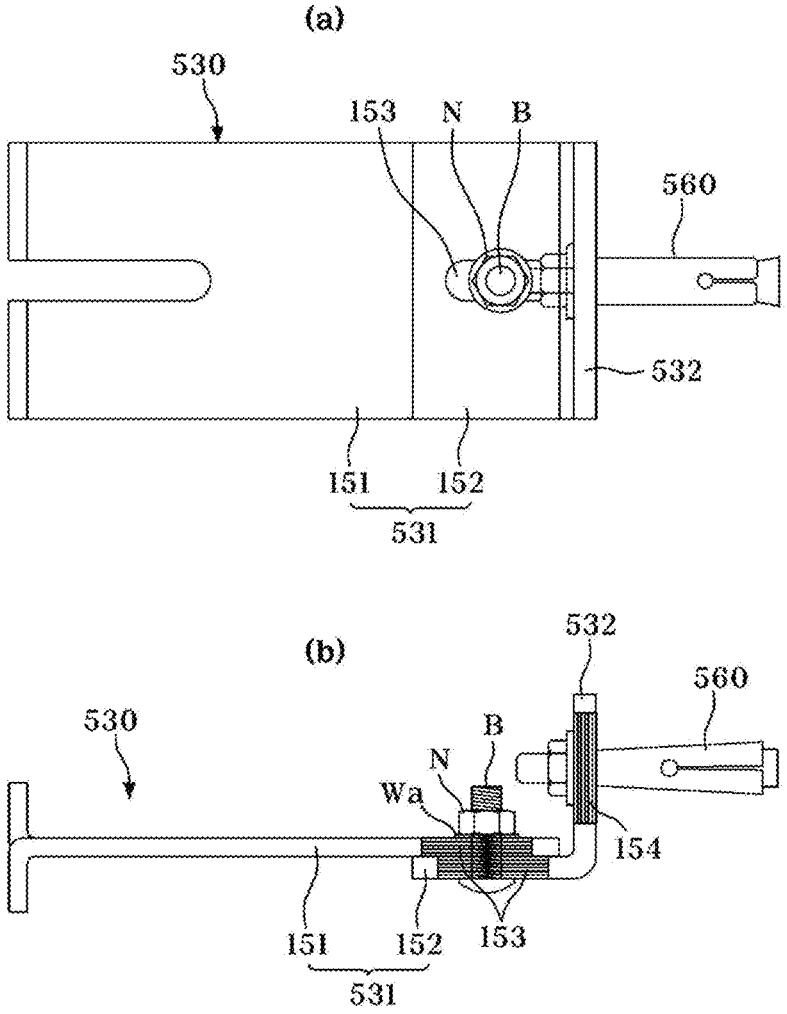
FIGS. 2A and 2B are a top view and a side cross-sectional view of examples of a variable panel fixing angle of an exterior composite panel of the conventional invention developed by the inventor of the present invention.
Figure 3:
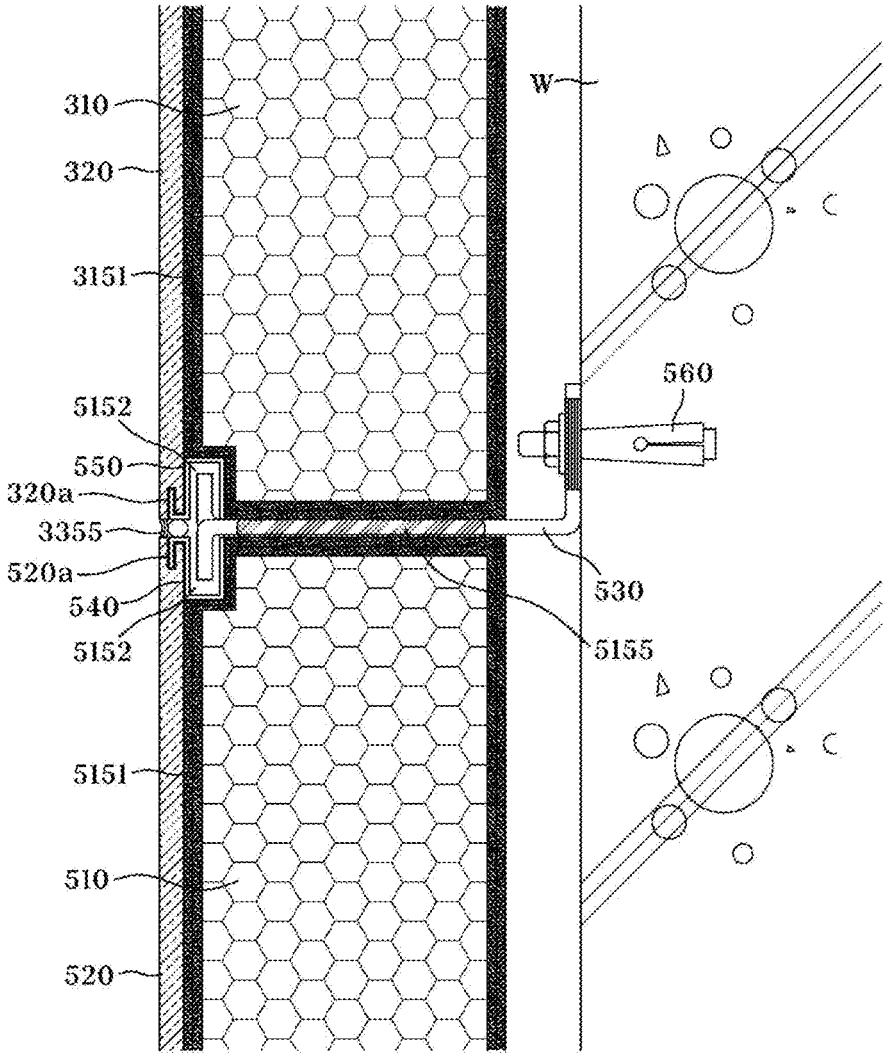
FIG. 3 is a side cross-sectional view illustrating vertically combined exterior composite panels of the conventional invention developed by the inventor of the present invention.
Figure 4:
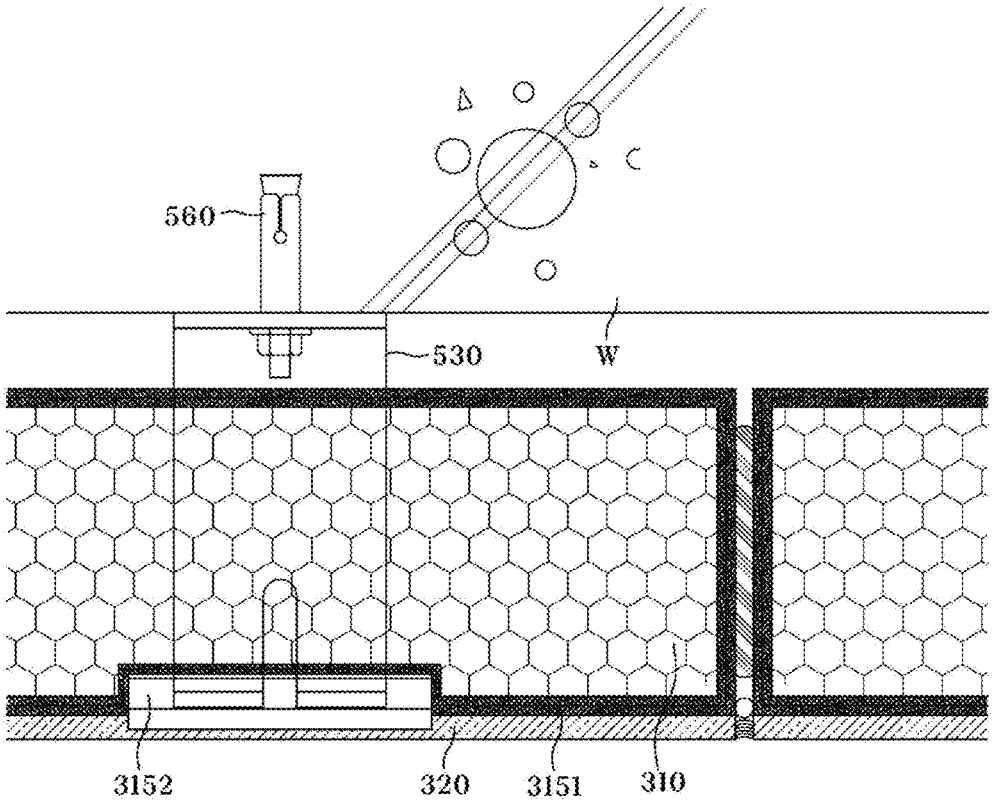
FIG. 4 is a top view illustrating the vertically combined exterior composite panels of the conventional invention developed by the inventor of the present invention.
Figure 5:
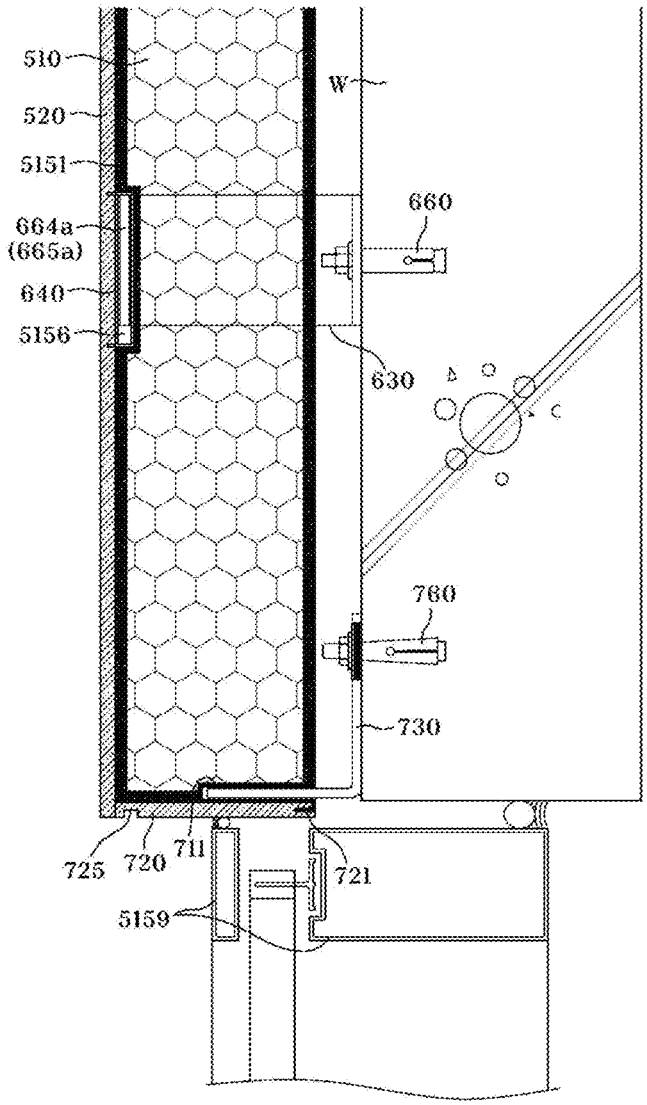
FIG. 5 is a side cross-sectional view illustrating a state in which the exterior composite panel of the conventional invention developed by the inventor is coupled to the top of a window frame.
Figure 6:
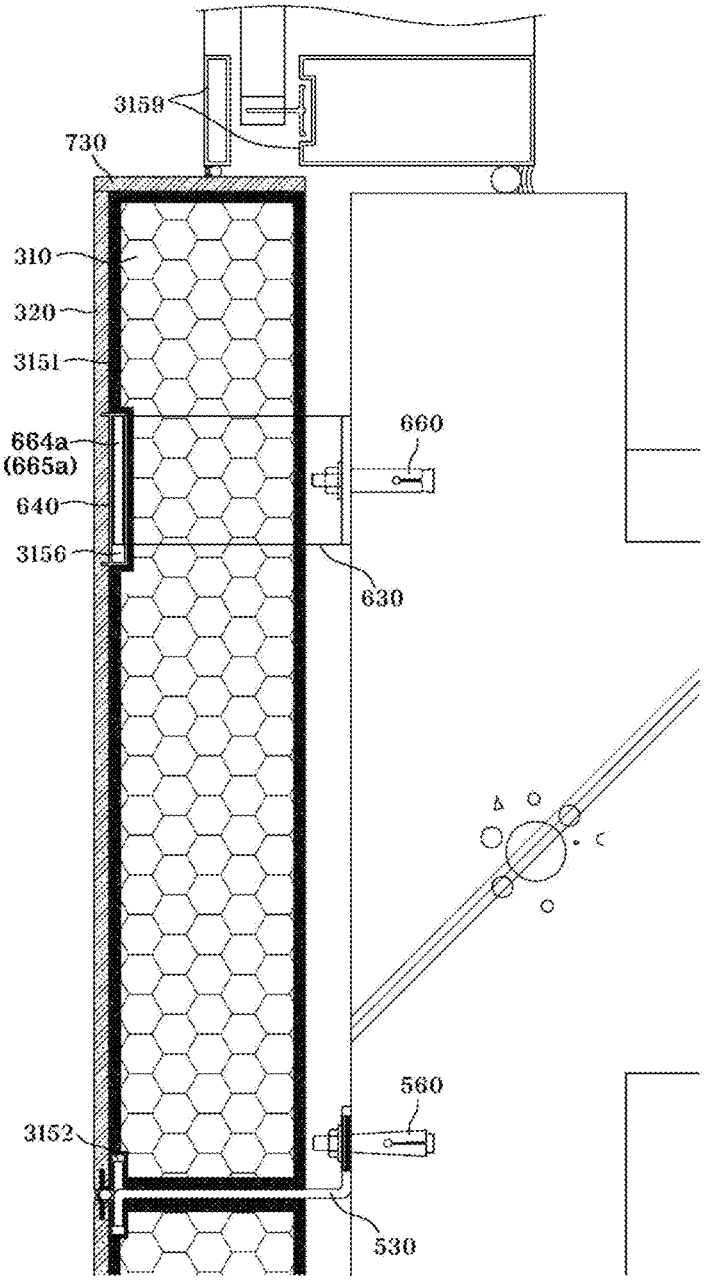
FIG. 6 is a side-sectional view illustrating a state in which the exterior composite panel of the conventional invention developed by the inventor is coupled to the bottom of the window frame.

Hereinafter, examples of a wall coupling structure using a composite panel with an ultra-slim stone panel combined with an insulation panel unit according to the present invention will be described with reference to the accompanying drawings. Throughout this process, the thickness of the lines shown in the drawings, as well as the sizes of the components, may be exaggerated for clarity and convenience of explanation. Additionally, the terms used herein are defined based on the functionality in the conventional invention, which may vary depending on the user's intentions or conventions. Therefore, the definitions of these terms should be inferred based on the content throughout this specification.

Furthermore, when reference numbers between the conventional invention and the present invention conflict, the descriptions for the conventional invention and the present invention should be read and understood separately.

First, a composite panel for preventing the spread of a fire due to an insulation material during a fire by simultaneously covering the exterior of the insulation material of the present invention with mortar and bonding an ultra-slim stone tile to a surface of the insulation material, and a unit wall coupling structure using the same will be described in full.

Figure 7:
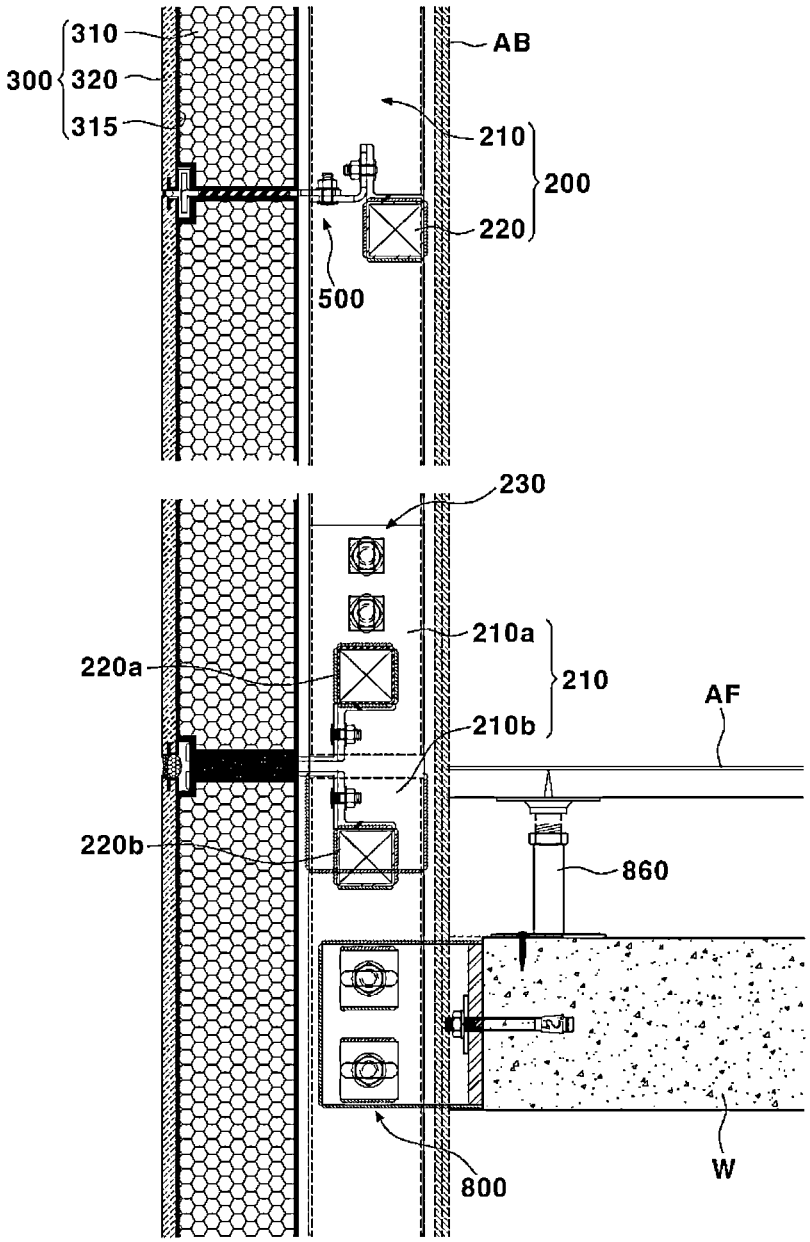
FIG. 7 is an overall vertical cross-sectional view illustrating a state in which the exterior composite panel of the present invention is coupled to a vertical bar or a horizontal bar in the absence of a retaining wall.
Figure 12:
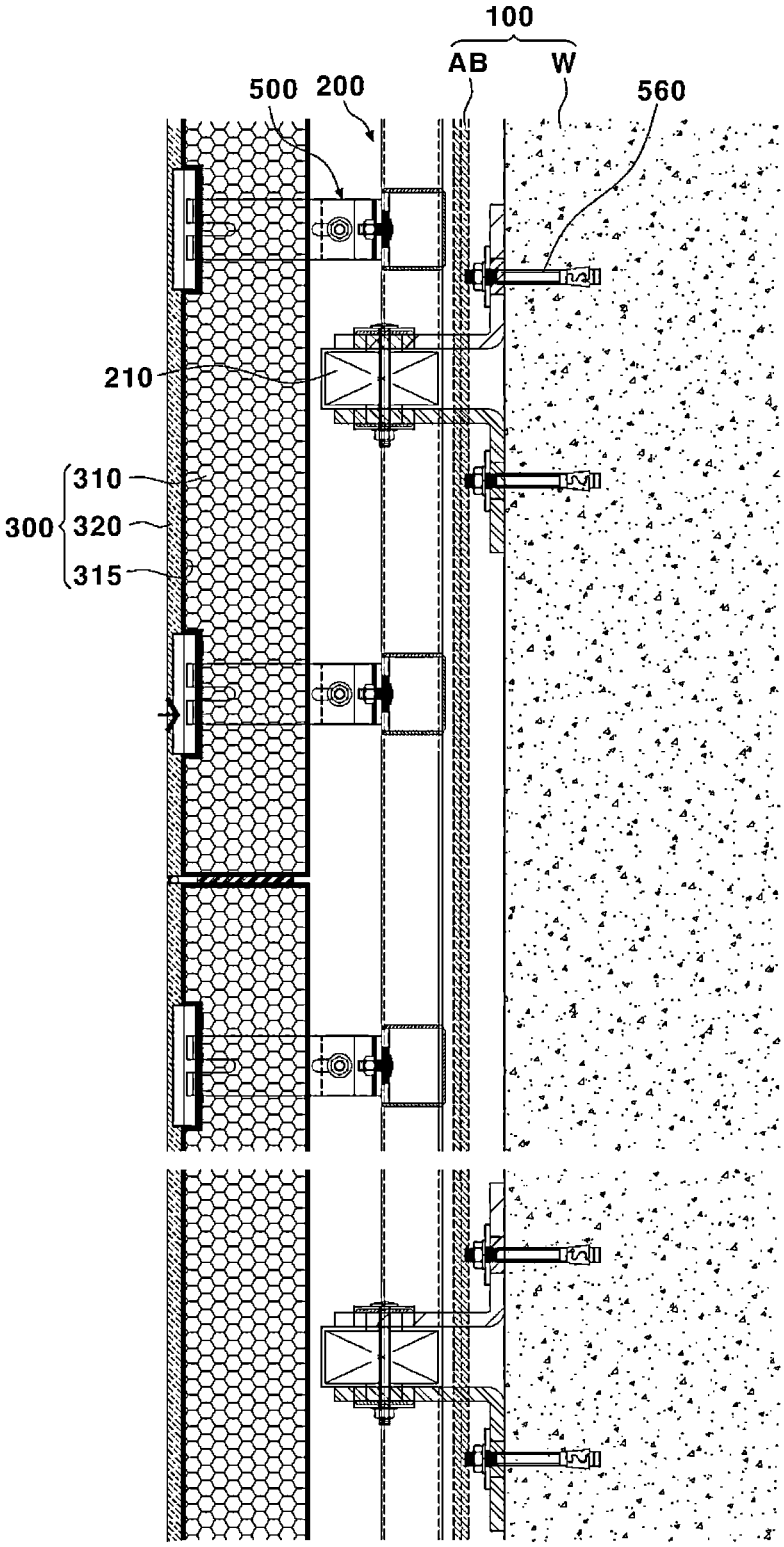
FIG. 12 is an overall top view illustrating a state in which the exterior composite panel of the present invention is coupled to the vertical bar or horizontal bar in the absence of a retaining wall.
Figure 16:
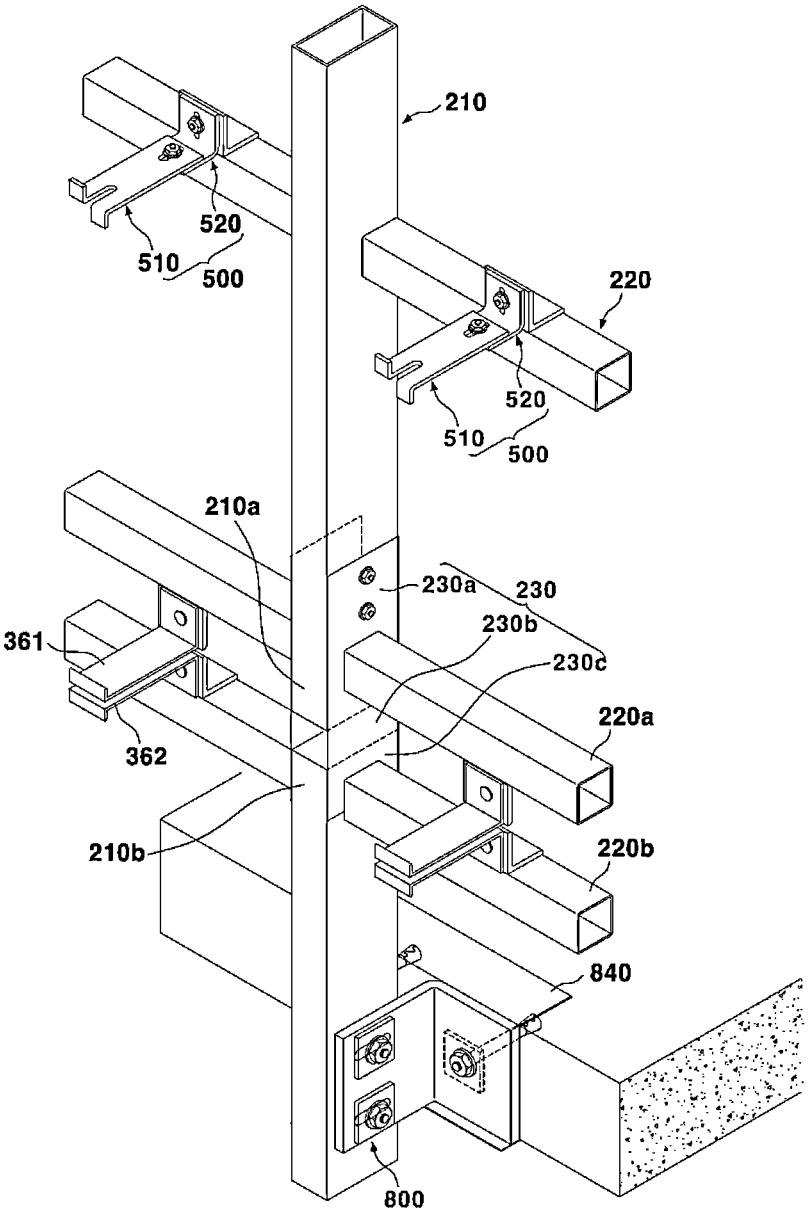
FIG. 16 is an overall perspective view illustrating the means of coupling the exterior composite panel of the present invention to the vertical bar or the horizontal bar in the absence of a retaining wall.

FIG. 7 is an overall vertical cross-sectional view illustrating a state in which the exterior composite panel of the present invention is coupled to a vertical bar or a horizontal bar in the absence of a retaining wall, FIG. 12 is an overall top view illustrating a state in which the exterior composite panel of the present invention is coupled to the vertical bar or horizontal bar in the absence of a retaining wall, and FIG. 16 is an overall perspective view illustrating the means of coupling the exterior composite panel of the present invention to the vertical bar or the horizontal bar in the absence of a retaining wall.

As shown in the drawings, the wall coupling structure includes a wall structure part 100, a vertical-horizontal frame structure 200, an insulation panel unit member 300, a panel fixing angle member 500, and a wall vertical connection member 800.

The wall structure part 100 includes a wall W and asbestos boards AB, the wall W is typically made of concrete or bricks, and the asbestos boards AB are installed after the basic framework construction of the building wall is completed and concrete casting is finished.

The asbestos collectively refers to a greyish material that is traditionally used as fire-resistant and insulating material in buildings.

Conventionally, exterior composite panels could be installed directly when there was a retaining wall. However, when there is no retaining wall, the exterior composite panels cannot be installed directly. Therefore, by using vertical or horizontal bars, the structure has been improved to primarily block a fire by the exterior composite panels in the event of a fire, then block the fire by a spatial layer while maintaining gaps, and thirdly, block the fire by asbestos boards AB.

Of course, a method is provided to block a fire using fire-resistant plates that also prevent a fire from spreading through gaps in the building floor.

The vertical-horizontal frame structure 200 includes a vertical bar 210 and a horizontal bar 220 formed as a quadrangular frame to install a composite panel on the exterior of the retaining wall. The vertical bar 210 includes an upper vertical bar 210*a* and a lower vertical bar 210*b* and is connected by an expansion joint 230 at a portion at which an access floor AF is formed.

In this case, a method of vertically connecting the vertical bars 210 has been already developed.

The upper vertical bar 210*a* is a general quadrangular frame and is manufactured in a length where each pipe is connected to form several floors. The lower vertical bar 210*b* is also a general quadrangular frame and is manufactured in a length where each pipe is connected to form several floors. The upper vertical bar 210*a* and the lower vertical bar 210*b* are connected by the expansion joint 230 at a portion where the access floor AF is formed between floors.

The expansion joint 230 is a flat rectangular steel plate and has a width equal to that of the vertical bars 210. At an upper portion of the expansion joint 230, upper expansion joints 230*a* are fastened on both sides of the upper vertical bar 210*a* by upper and lower vertical bar connecting bolts 213*a* and 213*b*. At a lower portion of the expansion joint 230, lower expansion joints 230*c* are fixed to both sides of the lower vertical bar 210*b* by welding.

Therefore, the upper vertical bar 210*a* and the lower vertical bar 210*b* are separated to form a middle expansion joint 230*b* of the expansion joint 230 that allows instantaneous displacement to be withstood during strong winds or earthquakes.

In another method of coupling the expansion joint 230, the expansion joint 230 is a flat rectangular steel plate and has a width smaller than that of the vertical bar 210. At an upper portion of the expansion joint 230, the upper expansion joints 230*a* are inserted into and fastened to the upper vertical bar 210*a* on both sides by the upper and lower vertical bar connecting bolts 213*a* and 213*b*. At a lower portion of the expansion joint 230, the lower expansion joints 230*c* are inserted into the lower vertical bar 210*b* and may be fixed to both sides of the lower vertical bar 210*b* by welding (or bolts).

The upper vertical bar 210*a* and the lower vertical bar 210*b* are coupled by the expansion joint 230 to form a gap therebetween, thereby withstanding instantaneous displacement during strong winds or earthquakes.

The horizontal bar 220 is perpendicularly connected to the vertical bar 210 to connect the composite panel. An "L"-shaped angle member is welded onto the horizontal bar 220 to connect the insulation panel unit members 300 using panel fixing angle members 500 at appropriate locations.

The insulation panel unit member 300 is formed as a unit product by an insulation panel unit 310, an ultra-slim stone panel 320, and polymer mortar 315 and manufactured according to the design of each building.

The panel fixing angle member 500 includes a panel fixing angle 510 and a "L"-shaped connection angle 520 and is coupled to the horizontal bar 220 by bolts and nuts.

Each component will be described in detail along while explaining an assembly structure.

A coupling relationship between the insulation panel unit member 300 and the horizontal bar 220 in the absence of a retaining wall will be described.

Figure 8:
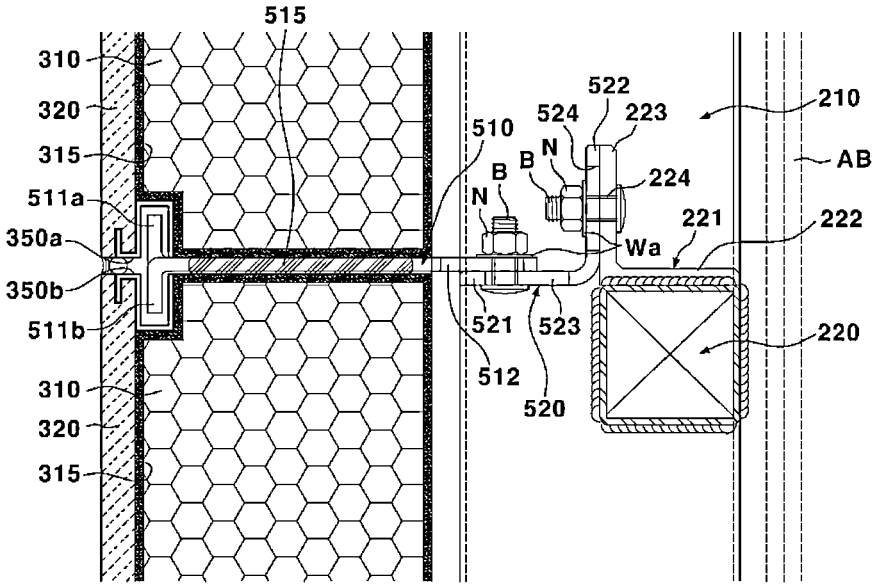
FIGS. 8*a* and 8*b* are overall vertical cross-sectional views illustrating a state in which upper and lower exterior composite panels of the present invention are coupled to a horizontal bar in the absence of a retaining wall.
Figure 8:
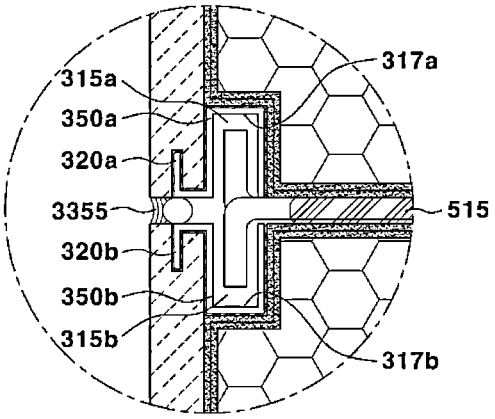
Figure 13:
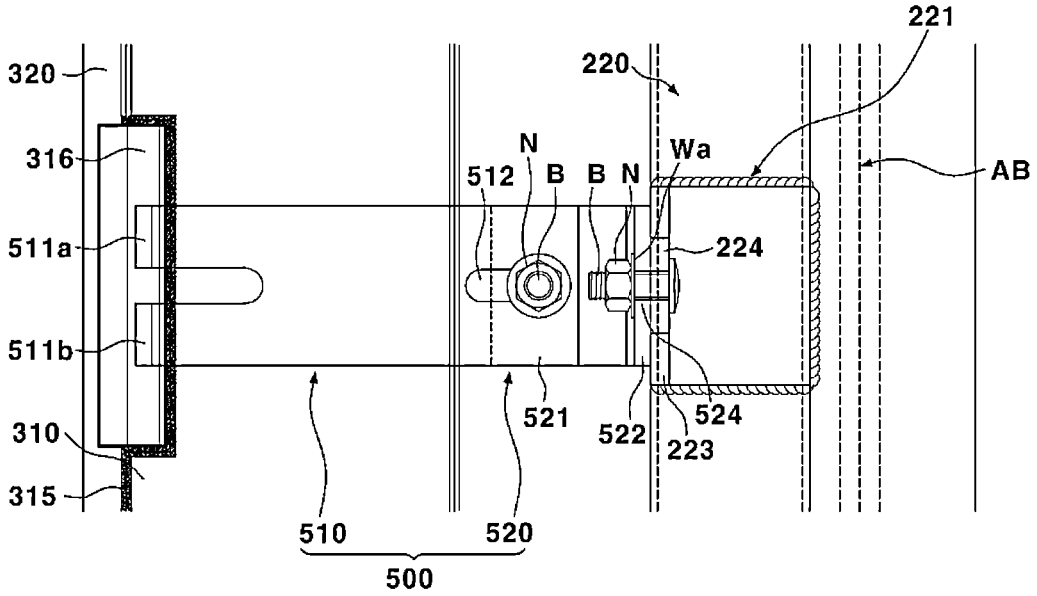
FIG. 13 is a top view illustrating a state in which the upper and lower exterior composite panels of the present invention are coupled to the horizontal bar by the panel fixing angle in the absence of a retaining wall.
Figure 17:
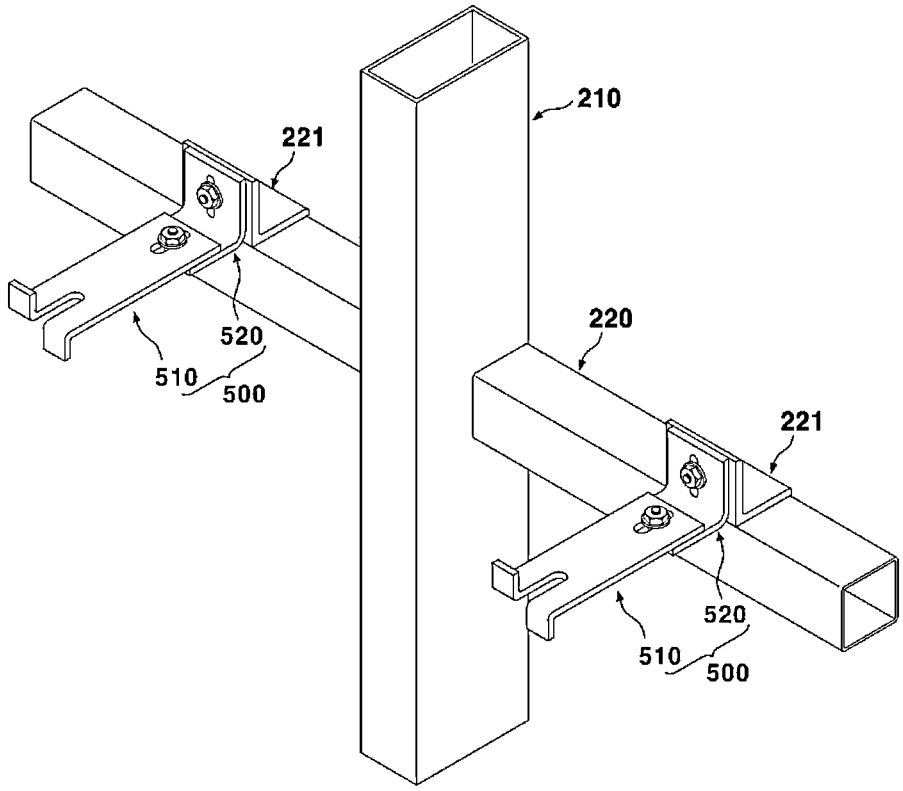
FIG. 17 is a perspective view illustrating the exterior composite panels of the present invention coupled to the horizontal bar by the panel fixing angle in the absence of a retaining wall.
Figure 18:
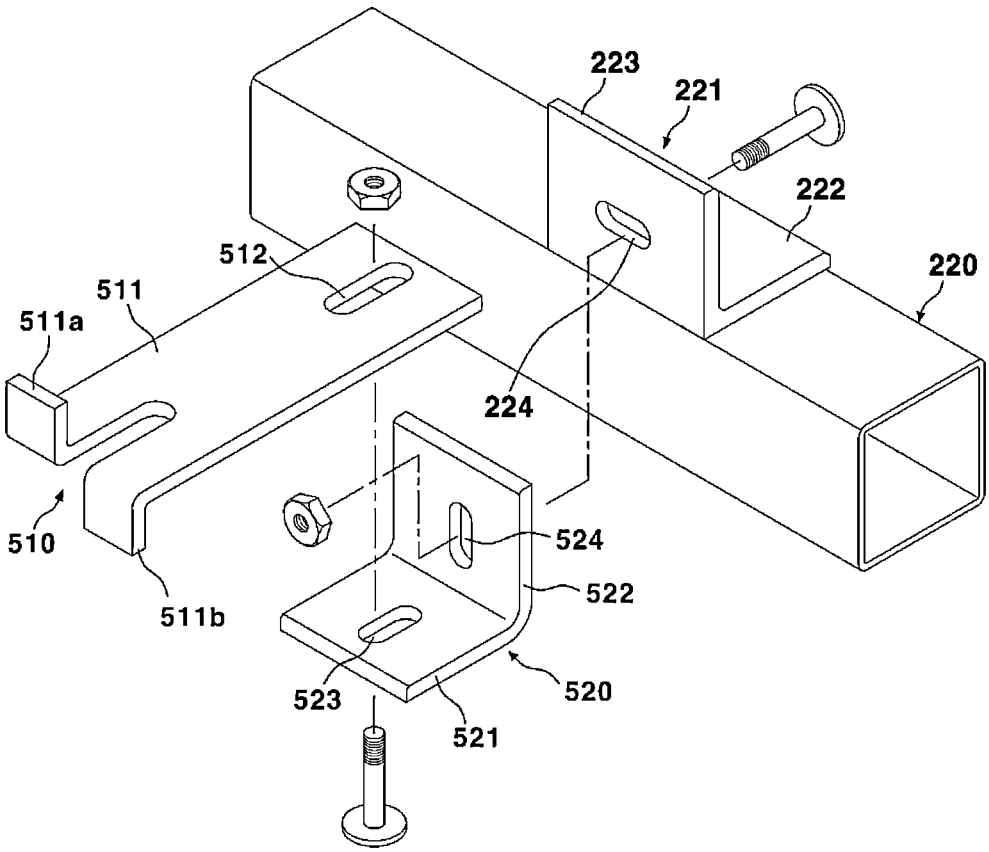
FIG. 18 is an exploded perspective view illustrating the exterior composite panels of the present invention coupled to the panel fixing angle by the horizontal bar in the absence of a retaining wall.

FIGS. 8*a* and 8*b* are overall vertical cross-sectional views illustrating a state in which upper and lower exterior composite panels of the present invention are coupled to a horizontal bar in the absence of a retaining wall, FIG. 13 is a top view illustrating a state in which the upper and lower exterior composite panels of the present invention are coupled to the horizontal bar by the panel fixing angle in the absence of a retaining wall, FIG. 17 is a perspective view illustrating the exterior composite panels of the present invention coupled to the horizontal bar by the panel fixing angle in the absence of a retaining wall, and FIG. 18 is an exploded perspective view illustrating the exterior composite panels of the present invention coupled to the panel fixing angle by the horizontal bar in the absence of a retaining wall.

First, the insulation panel unit member 300 divided into upper and lower parts is connected to the horizontal bar 220 by the panel fixing angle 510 and the "L"-shaped connection angle 520.

The drawing is a side cross-sectional view showing that a state in which the exterior composite panels are vertically coupled to the wall W using the panel fixing angle member 500 and anchor bolts to vertically couple the upper insulation panel unit 310 combined with the ultra-slim stone panel 320 for fire prevention and the lower insulation panel unit 310 combined with the ultra-slim stone panel 320.

The exterior of the upper and lower insulation panel units 310 is covered with polymer mortar 315, an upper panel catching groove 315*a* and a lower panel catching groove 315*b* are formed at a junction edge of the insulation panel unit 310 so that "ㄹ"-shaped fasteners 350*a* and 350*b* are inserted into the upper and lower panel catching grooves 315*a* and 315*b* for rigidity of the edge, and an upward catching part 511*a* and a downward catching part 511*b* of the panel fixing angle member 500 are inserted into the upper and lower panel catching grooves 317*a* and 317*b* of the "ㄹ"-shaped fasteners 350*a* and 350*b* fitted to the exterior of the polymer mortar 315 formed in the upper and lower panel catching grooves 315*a* and 315*b*.

The "ㄹ"-shaped fasteners 350*a* and 350*b* have a reverse "ㄹ" shape, are formed so that a large bent catching part 41 and a small bent catching part 43 face each other, and have a large catching wing part 42 and a small catching wing part 44 formed on both sides thereof. The large catching part 41 is inserted into a panel catching groove 11 of the insulation panel unit 310. The small catching part 43 is inserted into the stone catching groove 21 of the ultra-slim stone panel 320 and is fixedly attached to prevent shaking from an earthquake by filling gaps between the ultra-slim stone panel 320 and the "ㄹ"-shaped fasteners 350*a* and 350*b* with an epoxy.

Therefore, the upward and downward catching parts 511*a* and 511*b* are caught in the upper and lower panel catching grooves 317*a* and 317*b* of the large catching part 41 of the "ㄹ"-shaped fasteners 350*a* and 350*b*, respectively.

Therefore, a flame-retardant polyurethane foam filling part 515 is formed to withstand vibrations such as earthquakes by evenly filling the gap formed between the vertically coupled insulation panel units 310 with flame-retardant polyurethane foam.

Further, a gap is formed even when the ultra-slim stone panels 320 are coupled vertically. A sealing caulking part 3355 is also formed in the gap to withstand vibrations such as earthquakes by filling and sealing the gap with an epoxy.

The undescribed symbols 320*a* and 320*b* are fastener catching grooves which are formed at the ends of the ultra-slim stone panels 320 and in which the ends of the "ㄹ"-shaped fasteners 350*a* and 350*b* are caught.

The panel fixing angle 510 is coupled to the "L"-shaped connection angle 520 by bolts and nuts. The "L"-shaped connection angle 520 is also coupled to an "L"-shaped connection bracket 221 of the horizontal bar 220 by bolts and nuts.

The "L"-shaped connection angle 520 is fastened to the panel fixing angle 510 by bolts B, nuts N, and washers Wa so that a "L"-shaped connection angle long hole 523, which is formed in the horizontal connection bracket 521 of the "L"-shaped connection angle 520, corresponds to a panel fixing angle long hole 512 of the panel fixing angle 510.

The "L"-shaped connection angle 520 is fastened to the "L"-shaped connection bracket 221 using the bolts B, the nuts N, and the washer Wa so that a "L"-shaped connection angle long hole 524, which is formed on a vertical connecting bracket 522 of the "L"-shaped connection angle 520, corresponds to a bolt hole 224 formed in a vertical connecting bracket 223 of the "L"-shaped connection bracket 221.

A horizontal connection bracket 222 of the "L"-shaped connection bracket 221 is welded onto the horizontal bar 220 for fixation to maintain gaps during a fire, thereby preventing the fire from spreading throughout the building.

A coupling relationship, in which an expansion joint 230 is installed between the insulation panel unit member 300 and the horizontal bar 220 in the absence of a retaining wall to connect the insulation panel unit member 300 to upper and lower frames of the horizontal bar 220, will be described.

Figure 9:
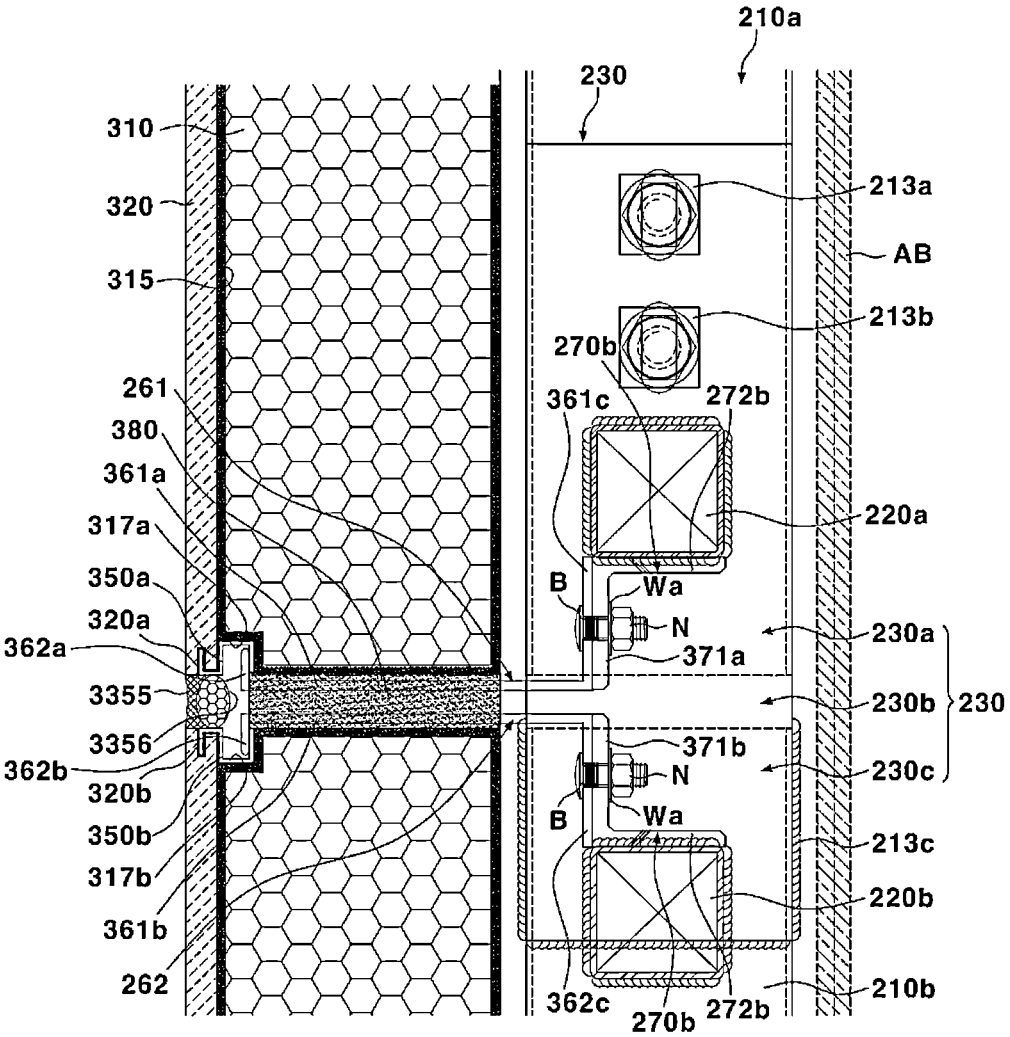
FIG. 9 is an overall vertical cross-sectional view illustrating a state in which the upper and lower exterior composite panels of the present invention are coupled to expansion joints of vertical bars in the absence of a retaining wall.
Figure 10:
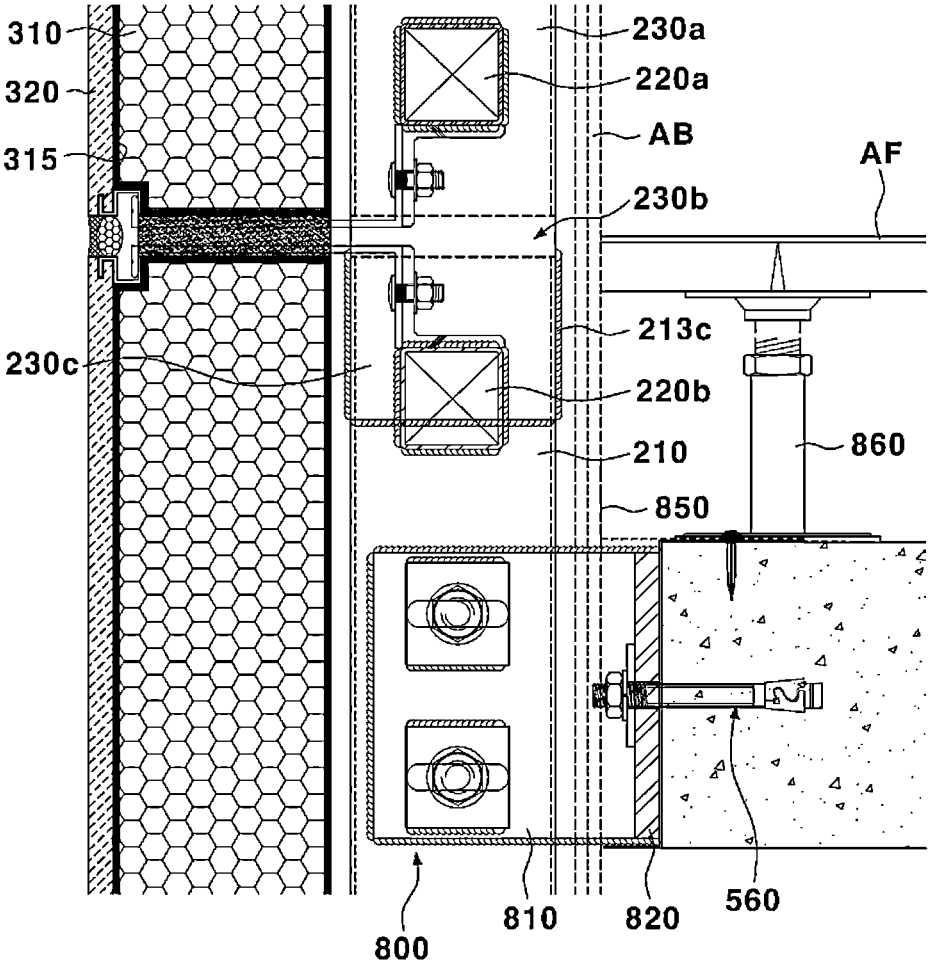
FIG. 10 is an overall vertical cross-sectional view illustrating a state in which the upper and lower exterior composite panels of the present invention are coupled to the expansion joint of the vertical bars and a connection state of a bottom panel in the absence of a retaining wall.
Figure 19:
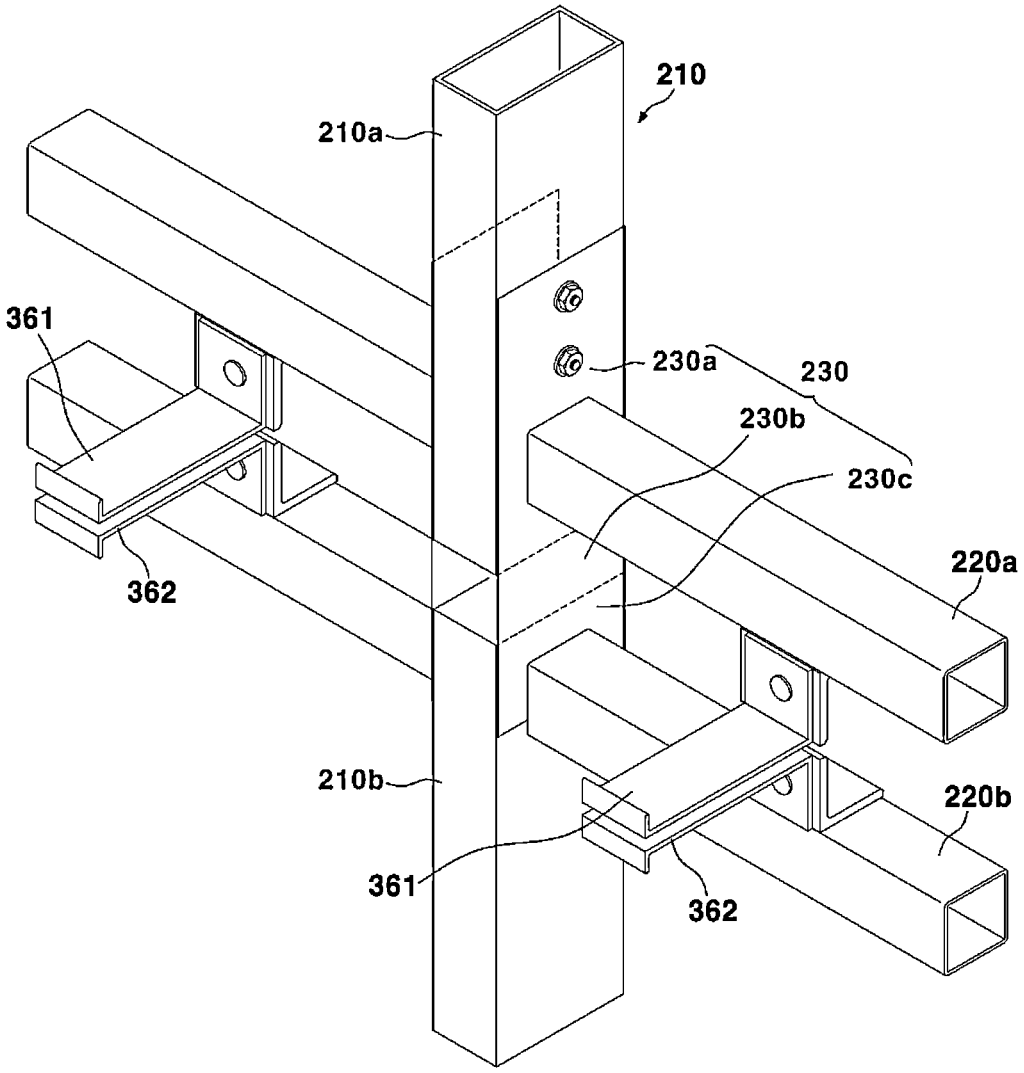
FIG. 19 is a perspective view illustrating a state in which the horizontal bars are coupled by the upper and lower fasteners after the exterior composite panels of the present invention are coupled to the vertically connected vertical bars by the expansion joints of the vertical bars in the absence of a retaining wall.
Figure 20:
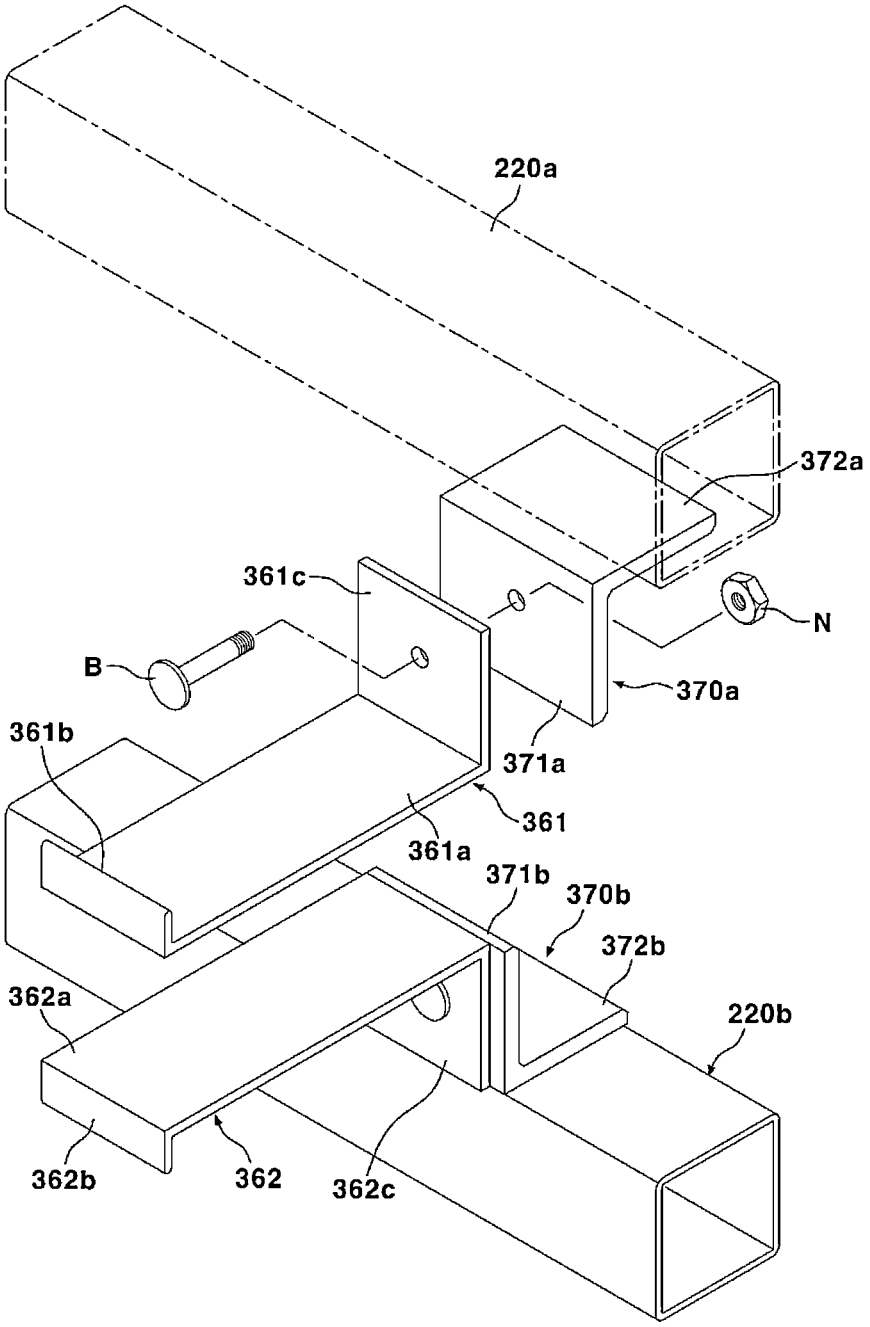
FIG. 20 is an exploded perspective view illustrating a state in which the horizontal bars are coupled by the upper and lower fasteners after the exterior composite panels of the present invention are coupled to the vertically connected vertical bars by the expansion joints of the vertical bars in the absence of a retaining wall.

FIG. 9 is an overall vertical cross-sectional view illustrating a state in which the upper and lower exterior composite panels of the present invention are coupled to expansion joints of vertical bars in the absence of a retaining wall, FIG. 19 is a perspective view illustrating a state in which the horizontal bars are coupled by the upper and lower fasteners after the exterior composite panels of the present invention are coupled to the vertically connected vertical bars by the expansion joints of the vertical bars in the absence of a retaining wall, and FIG. 20 is an exploded perspective view illustrating a state in which the horizontal bars are coupled by the upper and lower fasteners after the exterior composite panels of the present invention are coupled to the vertically connected vertical bars by the expansion joints of the vertical bars in the absence of a retaining wall.

As shown in the drawings, the insulation panel unit member 300 is connected at a portion at which the expansion joint 230 of the horizontal bar 220 is connected and is fastened to an upper horizontal bar 220*a* and a lower horizontal bar 220*b* by a "ㄷ"-shaped upper fastener 361 and a "ㄷ"-shaped lower fastener 362.

The method of vertically coupling the insulation panel unit member 300 is the same as the method of coupling the panel fixing angle member 500, and the panel fixing angle member 500 may be replaced with the "ㄷ"-shaped upper fastener 361 and the "ㄷ"-shaped lower fastener 362 for coupling.

Hereinafter, the present invention will be described in detail through the drawings.

The drawing is a cross-sectional view illustrating a state in which the exterior composite panels are vertically coupled to allow the "ㄷ"-shaped upper and lower fasteners 361 and 362 to couple the upper insulation panel unit 310 combined with the ultra-slim stone panel 320 and the lower insulation panel unit 310 combined with the ultra-slim stone panel 320 to the wall W using the anchor bolts.

Figure 14:
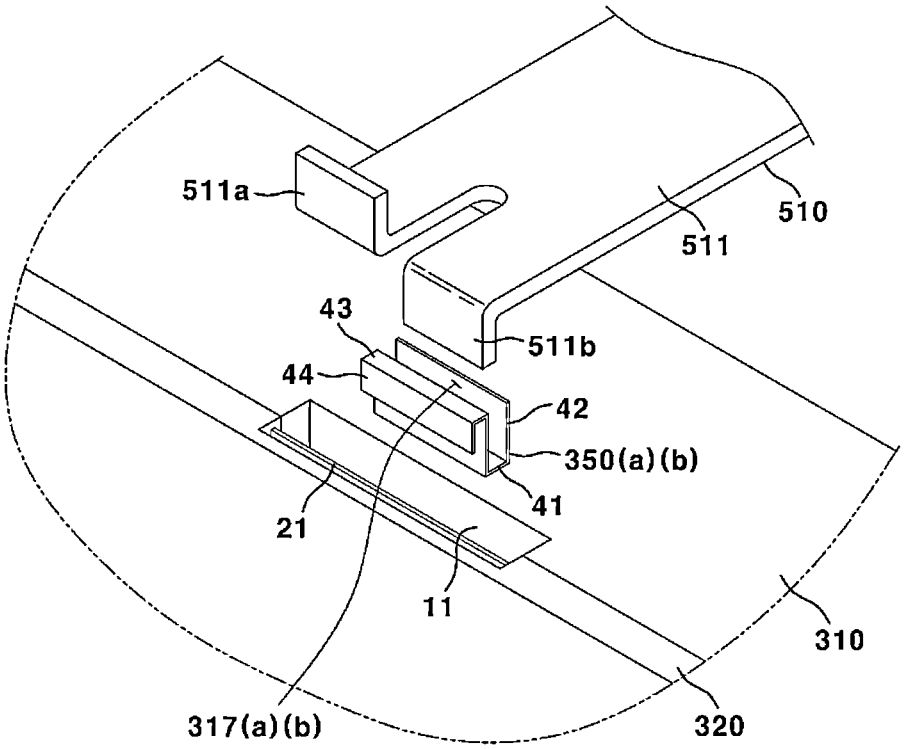
FIG. 14 is an exploded perspective view illustrating a state in which the upper and lower exterior composite panels of the present invention are coupled to the panel fixing angle in the absence of a retaining wall.

The exterior of the upper and lower insulation panel units 310 are covered with polymer mortar 315, and the upper and lower panel catching grooves 315*a* and 315*b* are formed at the junction edge of the insulation panel unit 310 so that the "ㄹ"-shaped fasteners 350*a* and 350*b* shown in FIG. 14 are inserted into the upper and lower panel catching grooves 315*a* and 315*b* for rigidity of the edge. An upward catching part 361*b* and a lower catching part 362*b* of the "ㄷ"-shaped lower fasteners 361 and 362 are inserted into upper and lower edge grooves 317*a* and 317*b* of the "ㄹ"-shaped fasteners 350*a* and 350*b* fitted to the exterior of the polymer mortar 315.

Therefore, a fire-resistant polyurethane foam filling part 380 is formed to withstand vibrations such as earthquakes by evenly filling a gap between the vertically coupled insulation panel units 310 with fire-resistant polyurethane foam.

Further, when the ultra-slim stone panels 320 are vertically coupled, a gap is formed between the coupled ultra-slim stone panels 320. A sealing caulking part 3355 is formed in the gap, and the gap is filled and sealed with an epoxy, thereby withstanding vibrations such as earthquakes.

Undescribed symbols 320*a* and 320*b* are fastener catching grooves formed in an end portion of the ultra-slim stone panels 320 so that the "ㄹ"-shaped fasteners 350*a* and 350*b* are caught therein, and a symbol 3356 is a spacer.

Meanwhile, the "ㄷ"-shaped upper fastener 361 is fastened by welding one end 372*a* of the "L"-shaped angle member 370*a*, which is bent into an "L"-shape, to a lower end of the upper horizontal bar 220*a* formed on the upper vertical bar 210*a* and fastening a fastener connecting end portion 361*c*, which is bent into the "L"-shape from a fastener middle part 361*a* of the "ㄷ"-shaped upper fastener 361, to the "L"-shaped angle member 370*a* using a bolt B, a nut N, and a washer Wa through a bolt hole of the other end 371*a*.

Further, the "ㄷ"-shaped lower fastener 362 is fastened by welding one end 372*b* of the "L"-shaped angle member 370*b*, which is bent into an "L"-shape, to an upper end of the lower horizontal bar 220*b* formed on the lower vertical bar 210*b* and fastening a fastener connecting end portion 362*c*, which is bent into the "L"-shape from a fastener middle part 362*a* of the "ㄷ"-shaped upper fastener 362 under the "⊏"-shaped upper fastener 361, to the "L"-shaped angle member 370*b* using a bolt B, a nut N, and a washer Wa through a bolt hole of the other end 371*b*.

Therefore, even when the insulation panel unit member 300 or the vertical bar 210 and the horizontal bar 220 shake due to strong winds or earthquakes, the shaking can be buffered by the "⊏"-shaped upper fastener 361 and the "⊏"-shaped lower fastener 362, and instantaneous displacement can be buffered by the expansion joint 230 formed on the vertical bar 210.

The expansion joint 230 is a flat rectangular steel plate and has a width equal to that of the vertical bar 210. Upper portions of the expansion joint 230 are fastened to both sides of the upper vertical bar 210*a* by the vertical bar connecting bolt 213*a* and the vertical bar connecting bolt 213*b*, and lower portions of the expansion joint 230 are fixed to both sides of the lower vertical bar 210*b* by expansion joint welding parts 213*c* by welding.

Next, a coupling relationship in which a wall vertical connection member 800 is installed between the vertical bar 210 and the wall W to connect the insulation panel unit member 300 to upper and lower frames of the horizontal bar 220 will be described.

Figure 11:
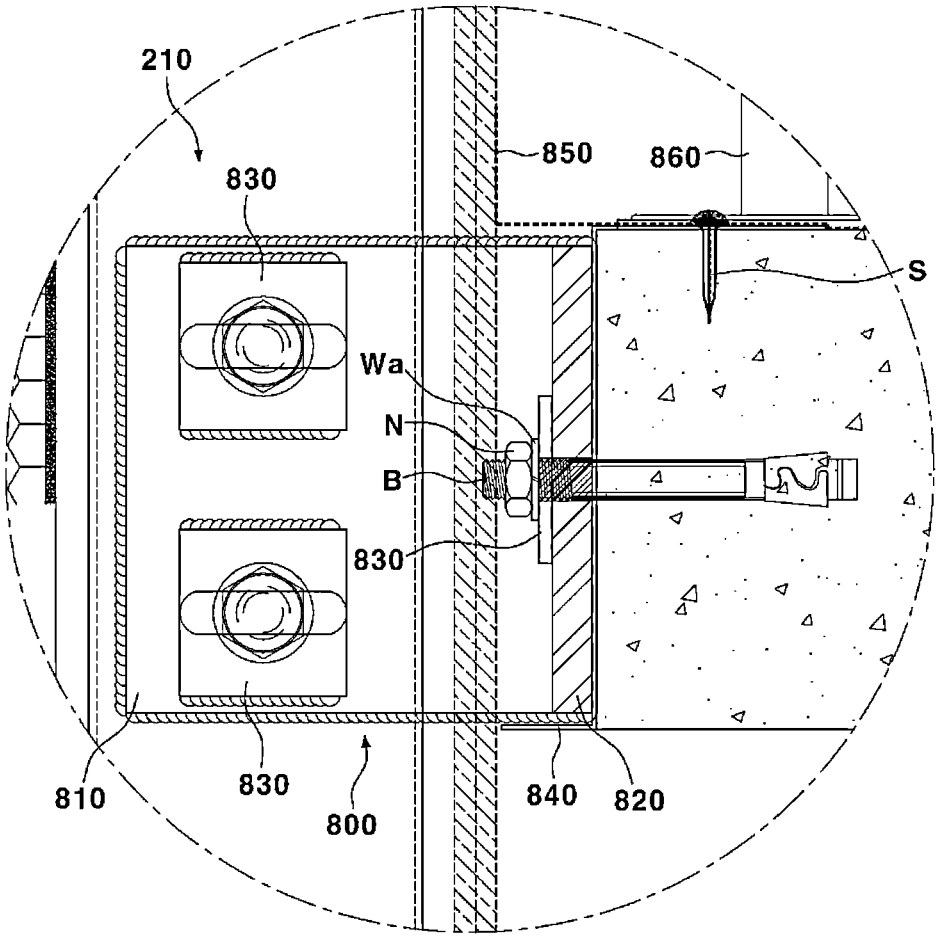
FIG. 11 is a vertical cross-sectional view illustrating the connection state of the vertical bar and the bottom panel in the absence of a retaining wall.
Figure 21:
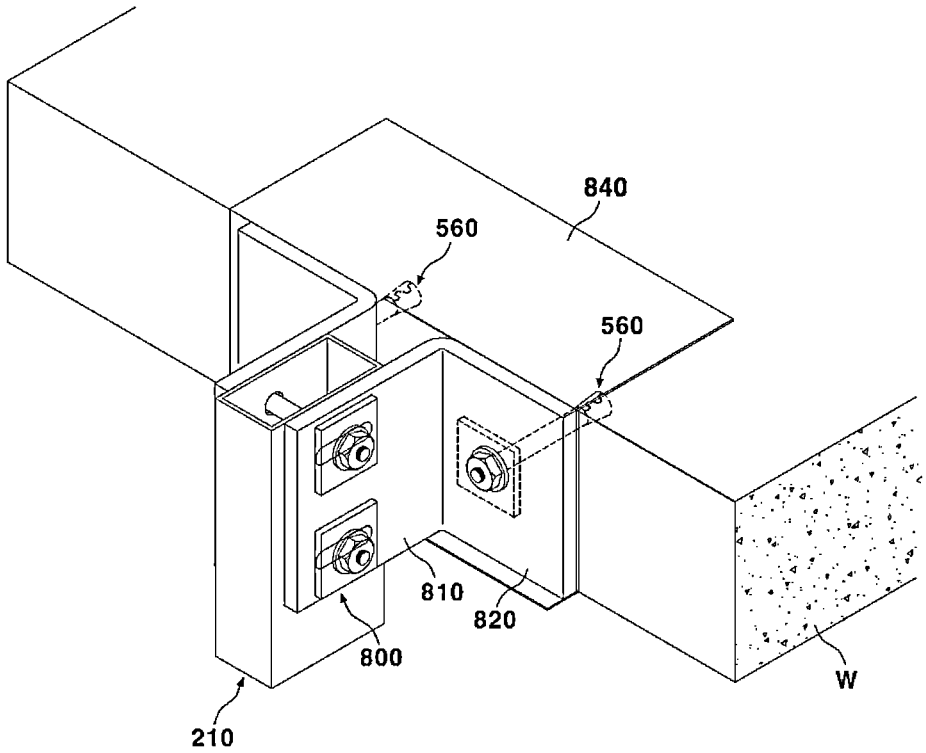
FIG. 21 is a perspective view illustrating a vertical member connecting member coupled to the vertical bar and the wall body in the absence of a retaining wall in the present invention.
Figure 22:
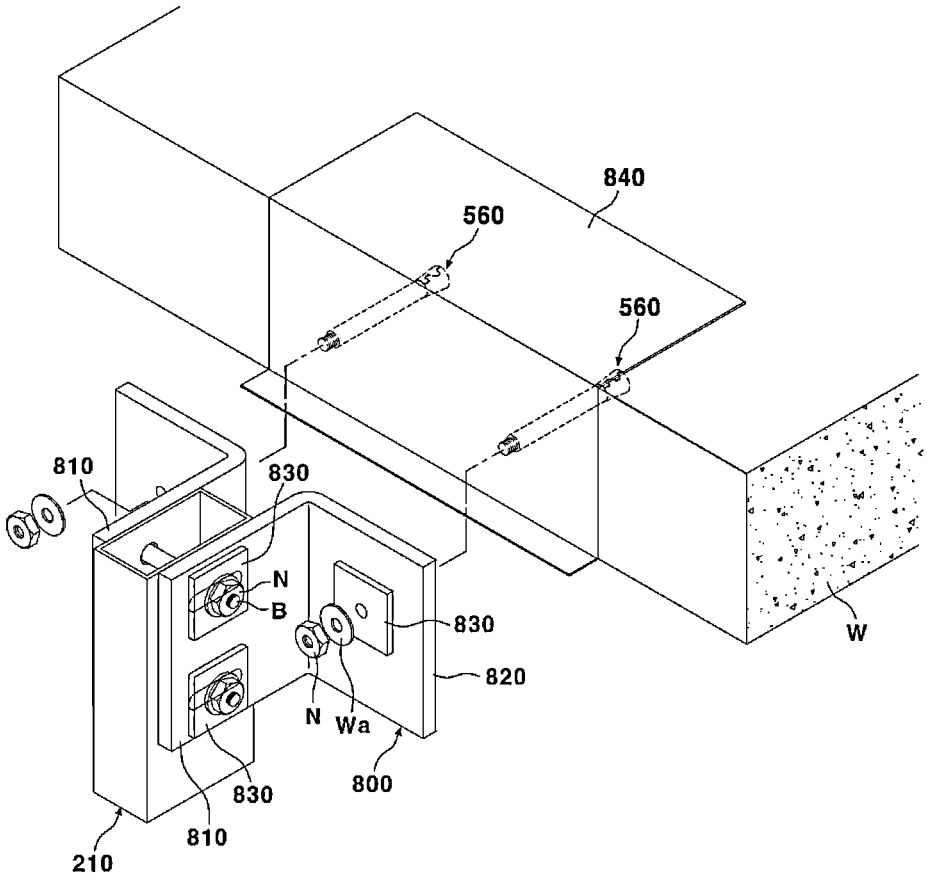
FIG. 22 is an exploded perspective view illustrating the vertical member connecting member coupled to the vertical bar and the wall body in the absence of a retaining wall in the present invention.
Figure 23:
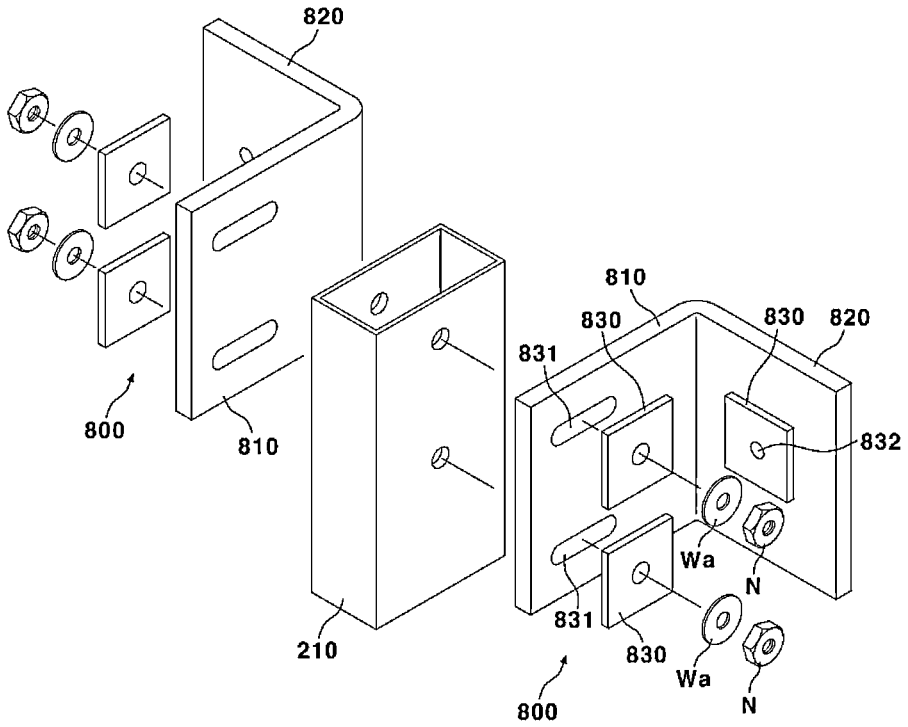
FIG. 23 is an exploded perspective view corresponding to FIG. 21 illustrating the vertical member connecting member coupled to the vertical bar and the wall body in the absence of a retaining wall in the present invention.

FIG. 11 is a vertical cross-sectional view illustrating the connection state of the vertical bar and the bottom panel in the absence of a retaining wall, FIG. 21 is a perspective view illustrating a vertical member connecting member coupled to the vertical bar and the wall body in the absence of a retaining wall in the present invention, FIG. 22 is an exploded perspective view illustrating the vertical member connecting member coupled to the vertical bar and the wall body in the absence of a retaining wall in the present invention, and FIG. 23 is an exploded perspective view corresponding to FIG. 21 illustrating the vertical member connecting member coupled to the vertical bar and the wall body in the absence of a retaining wall in the present invention.

As shown in the drawings, a wall vertical connection member 800 is attached and fastened to the vertical bar 210 and is fastened to the wall W, on which a steel plate bracket 840 is installed, by the anchor bolt 560.

The wall vertical connection member 800 is formed in an "L"-shape. A connection bracket reinforcing plate 830 is formed on one side of an "L"-shaped wall connecting bracket 810 for reinforcement of a steel plate. The "L"-shaped wall connecting bracket 810 is fastened to the vertical bar 210 by a bolt B, a nut B, and a washer Wa through a gap adjusting groove 831 of the "L"-shaped wall connecting bracket 810.

The wall vertical connection member 800 is formed in the "L"-shape. A connection bracket reinforcing plate 830 is formed on the other side of the "L"-shaped wall connecting bracket 820 for reinforcement of a steel plate. The connection bracket reinforcing plate 830 is placed on a steel plate bracket 840 fixed to the wall W on the floor through a bolt hole 832 of the "L"-shaped wall connecting bracket 820 to fasten the "L"-shaped wall connecting bracket 820 to the vertical bar 210 using the bolt B, the nut B, and the washer Wa of the anchor bolt 560.

An undescribed symbol 850 is a fire-resistant steel plate, a symbol 860 is a support that supports an access floor, and a symbol S is a fastening screw.

The following describes a coupling relationship of connecting the vertical bar 210 to the wall W using an "L"-shaped angle member 540.

Figure 15:
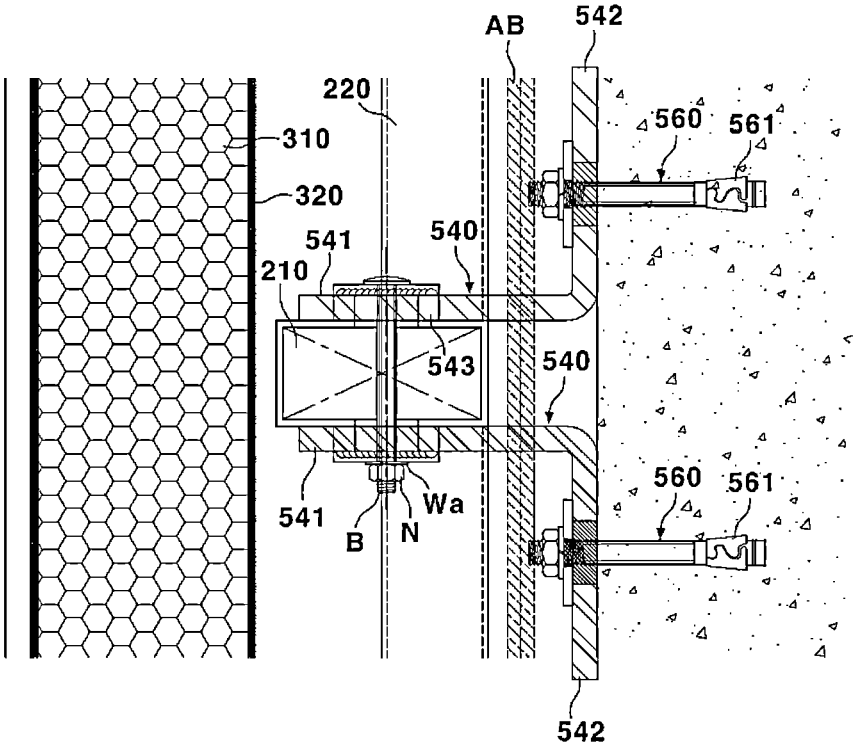
FIG. 15 is a top view illustrating a state in which the vertical bar is coupled to a wall body W in the present invention.

FIG. 15 is a top view illustrating a state in which the vertical bar is coupled to a wall body W in the present invention.

A coupling relationship between the vertical bar 210 and the horizontal bar 220 is as described above.

A bolt hole is formed in the middle of the vertical bar 210, the "L"-shaped angle members 540 on both sides of the frame are fixed to the wall W and are fastened to the vertical bar 210 by bolts B, nuts N, and washers Wa through the gap adjusting groove 543 formed in the vertical bar fastening angle part 541.

Further, the "L"-shaped angle members 540 are fixedly fastened to the wall W by the bolts B, the nuts N, and the washers Wa of the anchor bolt 560 through the gap adjusting groove 545 of the wall fastening angle part 542 formed on the other side of the vertical bar fastening angle part 541.

The undescribed symbol 561 is an expansion part of the anchor bolt 560 expanded from the wall.

Therefore, the present invention relates to a wall coupling structure using an exterior composite panel with an insulation panel unit combined with an ultra-slim stone panel. When a retaining wall is not present, the insulation panel unit member 300 is coupled with the horizontal bar 220, and the expansion joint 230 is installed between the insulation panel unit member 300 and the horizontal bar 220 to connect the insulation panel unit member 300 to upper and lower frames of the horizontal bar 220. When the wall vertical connection member 800 is installed between the wall W and the vertical bar 210 to connect the insulation panel unit member 300 to the upper and lower frames of the horizontal bar 220, a gap is formed between the upper vertical bar 210*a* and the lower vertical bar 210*b*, and the upper vertical bar 210*a* and the lower vertical bar 210*b* are coupled by the expansion joint 230. Thus, the structure can prevent instantaneous displacement caused by strong winds or earthquakes, be easily applied in the absence of a retaining wall, and be installed easily.

As described above, by using a vertical bar or a horizontal bar for fire safety management, the present invention can primarily prevent a fire using an exterior composite panel, block a fire through spatial layers while maintaining gaps, and thirdly, block the fire using asbestos boards AB, thereby addressing the problem of further human casualties due to a fire spreading in the event of a fire. This is because, in the conventional invention, when a retaining wall is present, an exterior composite panel can be directly constructed to the retaining wall, whereas when the retaining wall is not present, the exterior composite panel cannot be directly constructed to the retaining wall.

Further, the present invention is lightweight due to the manufacturing and structure of the insulation panel when attached to a wall, is resistant to earthquakes or strong winds, and has a simplified structure of the panel fixing angle even under construction to provide convenient attachment to a wall when installed as a dry structure, thereby providing ease of construction.

Provided is a structure that maintains the durability of the building against condensation due to moisture and temperature differentials caused by heavy rainfall or snowfall. When an external impact is applied to the wall, by filling a gap between the connections with an epoxy, a damaged portion can be repaired. Particularly, a drip inducer in the window frame section prevents water from seeping into the window frame.

Provided are a soundproofing and insulation panel unit and a coupling structure of the wall using the same. The soundproofing and insulation panel unit can be economical by being manufactured by integrating the insulation layer and finishing layer into the most simplified layer in a factory, breaking away from the conventional methods in manufacturing of insulation panels, having excellent surface strength, and preventing surface swelling, Provided are a soundproofing and insulation panel unit securely attached to a structure by improving the composition of adhesive mortar, and a wall coupling structure using the same.

Provided are a soundproofing and insulation panel unit which provides excellent durability, structural stability, fire resistance, sound insulation performance, thermal insulation performance, and moisture resistance by improving a structure of the insulation panel, and a wall coupling structure using the same.

Provided are a soundproofing and insulation panel unit which can allow even unskilled labor to construct the soundproofing and insulation panel with a predetermined level of quality using standardized materials for dry construction and can be economical due to convenient maintenance, and a wall coupling structure using the same.

The composite panel, which can prevent a fire from spreading due to insulation materials during a fire by mortar applied on the exterior of the insulation material and bonding an ultra-slim stone tile to a surface, and a unit wall coupling structure using the same have been described. It should be understood by those of skilled in the art that alterations may be made without departing from the spirit and scope of the present invention. Therefore, exemplary embodiments and claims disclosed in the present invention should be considered in a descriptive sense only and not for purposes of limitation. Accordingly, the scope of the present invention is defined in the claims rather than the detailed description, and any variations falling within the scope of equivalence should be interpreted as being encompassed by the invention.

What is claimed is:

1. A unit wall coupling structure for installing a composite panel on an exterior wall in the absence of a retaining wall, the structure comprising:

a wall structure part including a wall and a fire-resistant board;

a vertical-horizontal frame structure spaced apart from the wall so as to define a gap therebetween, the vertical-horizontal frame structure including:

a vertical bar; and a horizontal bar connected to the vertical bar;

an insulation panel unit member coupled to the horizontal bar, the insulation panel unit member including:

an insulation material;

a mortar layer covering an exterior of the insulation material; and an ultra-slim stone panel bonded to the mortar layer;

a panel fixing angle member coupling the insulation panel unit member to the horizontal bar; and a wall vertical connection member fixing the vertical bar to the wall, wherein the vertical bar comprises:

an upper vertical bar; and a lower vertical bar, and an expansion joint is disposed between the upper vertical bar and the lower vertical bar, wherein an upper portion of the expansion joint is fastened to both sides of the upper vertical bar by vertical bar connecting bolts, and a lower portion of the expansion joint is fixed to both sides of the lower vertical bar by welding, wherein the horizontal bar comprises:

an upper horizontal bar connected to the upper vertical bar; and a lower horizontal bar connected to the lower vertical bar and the upper horizontal bar and the lower horizontal bar are coupled to the insulation panel unit member by:

a "U"-shaped upper fastener and a "U"-shaped lower fastener, wherein the "U"-shaped upper fastener is coupled to a first "L"-shaped angle member, one end of the first "L"-shaped angle member being welded to a lower end of the upper horizontal bar and another end being fastened to the "U"-shaped upper fastener by a bolt and a nut, and the "U"-shaped lower fastener is coupled to a second "L"-shaped angle member, one end of the second "L"-shaped angle member being welded to an upper end of the lower horizontal bar and another end being fastened to the "U"-shaped lower fastener by a bolt and a nut.

2. The structure of claim 1, wherein the panel fixing angle member includes a panel fixing angle and an "L"-shaped connection angle and is coupled to the horizontal bar by a bolt and a nut, the "L"-shaped connection angle is fastened to an "L"-shaped connecting bracket using a bolt and a nut to correspond to an "L"-shaped connection angle long hole formed in a vertical connecting bracket of the "L"-shaped connection angle and a bolt hole formed in the vertical connecting bracket of the "L"-shaped connecting bracket, the bolt holes are formed in the middle part of the vertical bar, and "L"-shaped angle members fixed to the wall and having an "L"-shape" are fastened to the vertical bar by a bolt and a nut through a gap adjusting groove formed in a vertical bar fastening angle part, and the "L"-shaped angle members are fastened to the wall by a bolt and a nut of an anchor bolt through a gap adjusting groove formed in the other side of the "L"-shaped angle members.

3. The structure of claim 2, wherein the wall vertical connection member is coupled to the wall by the anchor bolt, and an "L"-shaped wall connecting bracket is fastened to the vertical bar by a bolt and a nut through a gap adjusting groove of an "L"-shaped vertical bar connecting bracket on one side of the wall vertical connection member and is fastened to the wall W by the bolt and the nut of the anchor bolt through a bolt hole of the "L"-shaped vertical bar connecting bracket on the other side of the wall vertical connection member.

4. The structure of claim 2, wherein the wall vertical connection member is coupled to the wall by the anchor bolt and is fastened to a steel plate bracket fixed to the wall on the floor through the bolt hole of the "L"-shaped vertical bar connecting bracket, and connection bracket reinforcing plates are formed on the "L"-shaped vertical bar connecting brackets on one side and the other side of the wall vertical connection member.

5. The structure of claim 1, wherein the panel fixing angle member includes a panel fixing angle and an "L"-shaped connection angle and is coupled to the horizontal bar by a bolt and a nut, the "L"-shaped connection angle is fastened to an "L"-shaped connecting bracket using a bolt and a nut to correspond to an "L"-shaped connection angle long hole formed in a vertical connecting bracket of the "L"-shaped connection angle and a bolt hole formed in the vertical connecting bracket of the "L"-shaped connecting bracket, the bolt holes are formed in the middle part of the vertical bar, and "L"-shaped angle members fixed to the wall and having an "L"-shape" are fastened to the vertical bar by a bolt and a nut through a gap adjusting groove formed in a vertical bar fastening angle part, and the "L"-shaped angle members are fastened to the wall by a bolt and a nut of an anchor bolt through a gap adjusting groove formed in the other side of the "L"-shaped angle members.

* * * * *